350-332 SR
PTH17 XR 4,110,967

United States Patent [19]
Fujita

[11] 4,110,967
[45] Sep. 5, 1978

[54] METHOD AND SYSTEM FOR DRIVING LIQUID CRYSTAL DISPLAY DEVICE

[76] Inventor: Hiro Fujita, No. 31-1-2-807, 1-chome, Sayamadai, Sayama-shi, Saitama-ken, Japan

[21] Appl. No.: 719,110

[22] Filed: Aug. 31, 1976

[30] Foreign Application Priority Data

| | | | |
|---|---|---|---|
| Feb. 19, 1976 | [JP] | Japan | 51-17197 |
| Jun. 2, 1976 | [JP] | Japan | 51-63545 |
| Sep. 2, 1975 | [JP] | Japan | 50-106175 |

[51] Int. Cl.[2] ..... G04B 19/30
[52] U.S. Cl. ..... 58/23 R; 58/50 R
[58] Field of Search ..... 58/4 A, 24 R, 23 R, 58/23 A, 50 R, 152 R; 340/324 M, 336

[56] References Cited

U.S. PATENT DOCUMENTS

| | | | |
|---|---|---|---|
| 3,750,139 | 7/1973 | Blishar | 340/336 |
| 3,772,874 | 11/1973 | Lefkowitz | 58/50 R |
| 3,898,646 | 8/1975 | Washizura | 340/336 |
| 3,969,719 | 7/1976 | Sirocka et al. | 340/336 |
| 3,974,994 | 8/1976 | Washizura | 58/50 R |
| 4,014,012 | 8/1977 | Caudel | 340/336 |

*Primary Examiner*—Robert K. Schaefer
*Assistant Examiner*—Vit W. Miska
*Attorney, Agent, or Firm*—Holman & Stern

[57] ABSTRACT

A method and system for driving a liquid crystal display device including a first display section arranged in a first predetermined manner and a second display section arranged in a second predetermined manner, in which the first display section is driven in a static display mode whereas the second display section is driven in a matrix display mode.

4 Claims, 34 Drawing Figures

50
POWER SOURCE
52
D. C CONVERTER
Vo
2Vo
0
54
FREQUENCY STANDARD
56
FREQUENCY CONVERTER
58
1st TIME COUNTER
60
DECODER
2Vo
62
LEVEL SHIFTER
66
23
2Vo
LEVEL SHIFTER
SEGMENT ELECTRODE DRIVER
64
22
10
24
25
DIGIT ELECTRODE DRIVER
76
78
2Vo
LEVEL SHIFTER
SEGMENT ELECTRODE DRIVER
72
2Vo
74
LEVEL SHIFTER
DECODER
70
2nd TIME COUNTER
68

50
POWER SOURCE
52
D.C CONVERTER
Vo
2Vo
0
54
FREQUENCY STANDARD
56
FREQUENCY CONVERTER
58
TIME COUNTER
60
DECODER
2Vo
62
LEVEL SHIFTER
66
23
LEVEL SHIFTER
2Vo
SEGMENT ELECTRODE DRIVER
64
22
10
25
DIGIT ELECTRODE DRIVER
76
24
2Vo
74
SEGMENT ELECTRODE DRIVER
72
LEVEL SHIFTER
94
2Vo
0
D.C CONVERTER
POWER SOURCE
Vo
92
2Vo
LEVEL SHIFTER
78
DECODER
104
90
OSCILLATOR CIRCUIT
96
CALCULATOR CIRCUIT
100
FREQUENCY DIVIDER
98
KEYBOARD
102

METHOD AND SYSTEM FOR DRIVING LIQUID CRYSTAL DISPLAY DEVICE

This invention relates to a method and system for driving a liquid crystal display device and, more particularly, to a method and system for driving a liquid crystal display device of an electronic timepiece in static and matrix display modes.

In recent years, liquid crystal dispaly devices have been increasingly used in various applications such as electronic timepieces, desk calculators, etc., because of low power consumption. It is known in the art that there are two types of arrangements for the electrodes of the liquid crystal display devices, i.e., a static type arrangement and a matrix type arrangement. In the static type arrangement, the liquid crystal display device comprises a common electrode and a plurality of groups of segment electrodes displaced from and disposed opposite the common electrode. The segment electrodes of each group are not interconnected and independently driven from each other. This arrangement is advantageous in that a driver circuit for each segment electrode can be manufactured in a simple construction. However, this has drawbacks in that a number of driver circuits are required and increases the number of leads from the liquid crystal display device, increasing packaging cost and complexity.

In the matrix type arrangement, the liquid crystal dispaly device comprises a plurality of digit electrodes, and a plurality of segment electrodes displaced from and disposed opposite all of the digit electrodes. The segment electrodes relative to each digit electrode are interconnected, and the digit electrodes are provided independently from each other. Generally, the digit electrodes are driven in a time multiplexed relationship. With this arrangement, the number of leads from the liquid crystal display device is remarkably reduced, representing a considerable saving in packaging cost and complexity. However, this suffers from drawbacks in the design of driver circuits because of inherent characteristics of the liquid crystal.

Usually, a static drive system makes it possible to drive the electrodes with an alternating voltage signal having a substantially 100% duty cycle, remarkably increasing the dispaly contrast. In cases where the liquid crystal dispaly device is driven in a matrix mode, the duty cycle of a drive pulse applied to the electrodes is considerably reduced with the increase in the number of the digit electrodes, decreasing the display contrast very seriously.

As is well known, recent trend in electronic timepieces has been to increase the number of functions in addition to the basic timekeeping function. These functions necessarily increases the components of the timepiece, including dispaly elements. With respect to space and wiring, it is desirable to arrange the liquid dispaly device in the matrix arrangement. However, if all of the display stations of the dispaly device are driven in the matrix mode, the display contrast is reduced and it becomes difficult to identify various data dispalyed on the same display surface.

It is, therefore, an object of the present invention to provide a method for driving a liquid crystal dispaly device in static and matrix modes which can overcome the shortcomings encountered in the prior art.

It is another object of the present invention to provide a driving system for a liquid crystal display device including a first dispaly section arranged in a static configuration and a second display section arranged in a matrix configuration.

It is another object of the present invention to provide an electronic timepiece employing a liquid crystal display device incorporating the features of a static arrangement and a matrix arrangement.

It is another object of the present invention to provide an electronic timepiece incorporating a liquid crystal display device having a plurality of display stations adapted to be driven by a static drive system and a matrix drive system.

It is still another object of the present invention to provide an electronic timepiece employing a liquid crystal dispaly device which occupies a minimum space and overcomes wiring problems encountered in the prior art.

It is still another object of the present invention to provide an electronic timepiece employing a liquid crystal display device and a driving system including a static drive system and a matrix drive system for the dispaly device.

It is a further object of the present invention to provide an electronic timepiece employing a liquid crystal dispaly device which requires a minimum space but provides a clear dispaly contrast.

It is a still further object of the present invention to provide an electronic timepiece incorporating a miniaturized electronic calculator and a liquid crystal display device including a first display section for the dispaly of time data in a static display mode and a second display section for the display of calculated data in a matrix dispaly mode.

These and other, objects, features and advantages of the present invention will become more apparent from the following description when taken in conjunction with the accompanying drawings, in which.

Figure 1:
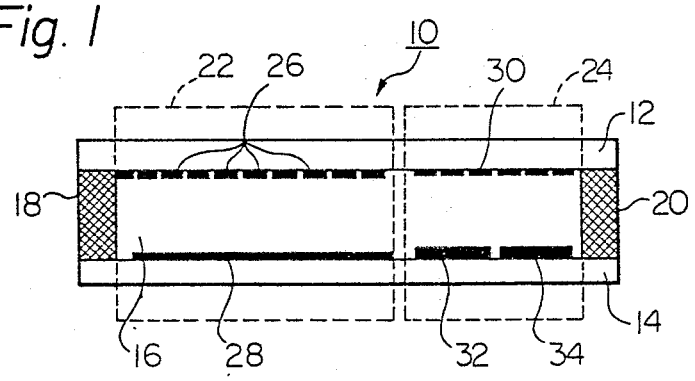
FIG. 1 is a cross sectional view of a liquid crystal display device to which a driving method of the present invention is applied.

Referring now to FIG. 1, there is shown in cross section a preferred example of a liquid crystal display device to carry out a driving method of the present invention. As shown, the liquid crystal display device, generally designated at 10, includes a pair of spaced transparent glass plates 12 and 14 between which is suitably sealed a body of suitable liquid crystal material 16 such as a suitable body of nematic liquid crystal material by means of spacers 18 and 20. In such an arrangement, the liquid crystal display device is composed of a first display section 22 and a second display section 24 integrally formed within the single cell 10. The first display section 22 comprises a plurality of groups of segment electrodes 26 located on the inner surface of the transparent glass plate 12, and a common electrode 28 located on the inner surface of the transparent glass plate 14. Thus, the segment electrodes 26 are displaced from and disposed opposite the common electrode 28. Likewise, the second display section 24 comprises a plurality of segment electrodes 30 located on the inner surface of the transparent glass plate 12, and a plurality of digit electrodes 32 and 34, the segment electrodes and the digit electrodes being arranged in the form of a matrix configuration in which the segment electrodes 30 are displaced from and disposed opposite the digit electrodes 32 and 34.

Figure 2:
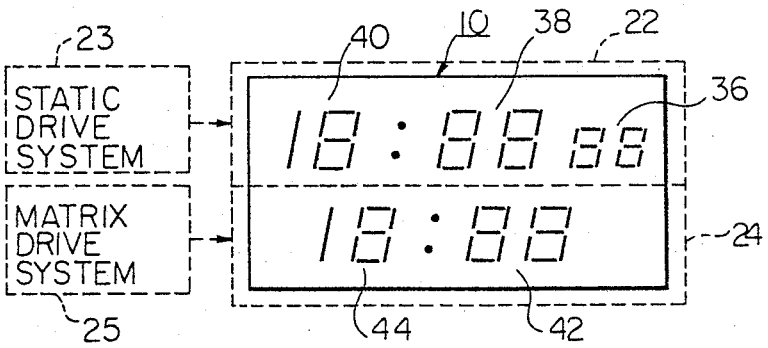
FIG. 2 is a schematic view of a one example of a dispaly surface of the liquid crystal dispaly device shown in FIG. 1.

FIG. 2 shows an example of a display surface for an electronic timepiece incorporating the liquid crystal display device shown in FIG. 1. In FIG. 2, the first display section 22 is connected to a static drive system 23 and composed of a seconds display station 36, a minutes display station 38 and an hours display station 40. Each digit of the display stations 36 and 38 is constituted by seven segment electrodes disposed opposite the common electrode and the display station 40 is constituted by eight segment electrodes disposed opposite the common electrode as shown in FIG. 1. The static drive system 23 is arranged to continuously apply a first relatively low frequency, alternating voltage signal at a predetermined amplitude level of one polarity to the common electrode of the first display section 22 and selectively apply a second relatively low frequency, alternating voltage signal at the predetermined amplitude level of the opposite polarity to a selected one or selected ones of a plurality of groups of segment electrodes in response to the time data signal produced by a decoder as will be subsequently described in detail. The predetermined amplitude level is selected to be lower than the voltage threshold level for light scattering from the liquid crystal. On the other hand, the second display section 24 is coupled to a matrix drive system 25 and composed of a dates display station 42 and a months display station 44. In the second display section 24, all of the digits have first and second digit electrodes which are formed on the inner surface of one of the transparent glass plates and not interconnected with one another. Each digit has first, second, third and fourth segment electrodes which are disposed on the inner surface of the other transparent glass plate in a matrix configuration with respect to the digit electrodes. The matrix drive system 25 is arranged to apply first and second voltage signals to the first and second digit electrodes of the second display section 24, the second voltage signal being out of phase from the first voltage signal and sequentially varying in amplitude at first, second and third voltage levels. The matrix drive system 25 is also arranged to apply a selected one of a plurality of alternating voltage signals to a selected one of the segment electrodes.

Figure 3:
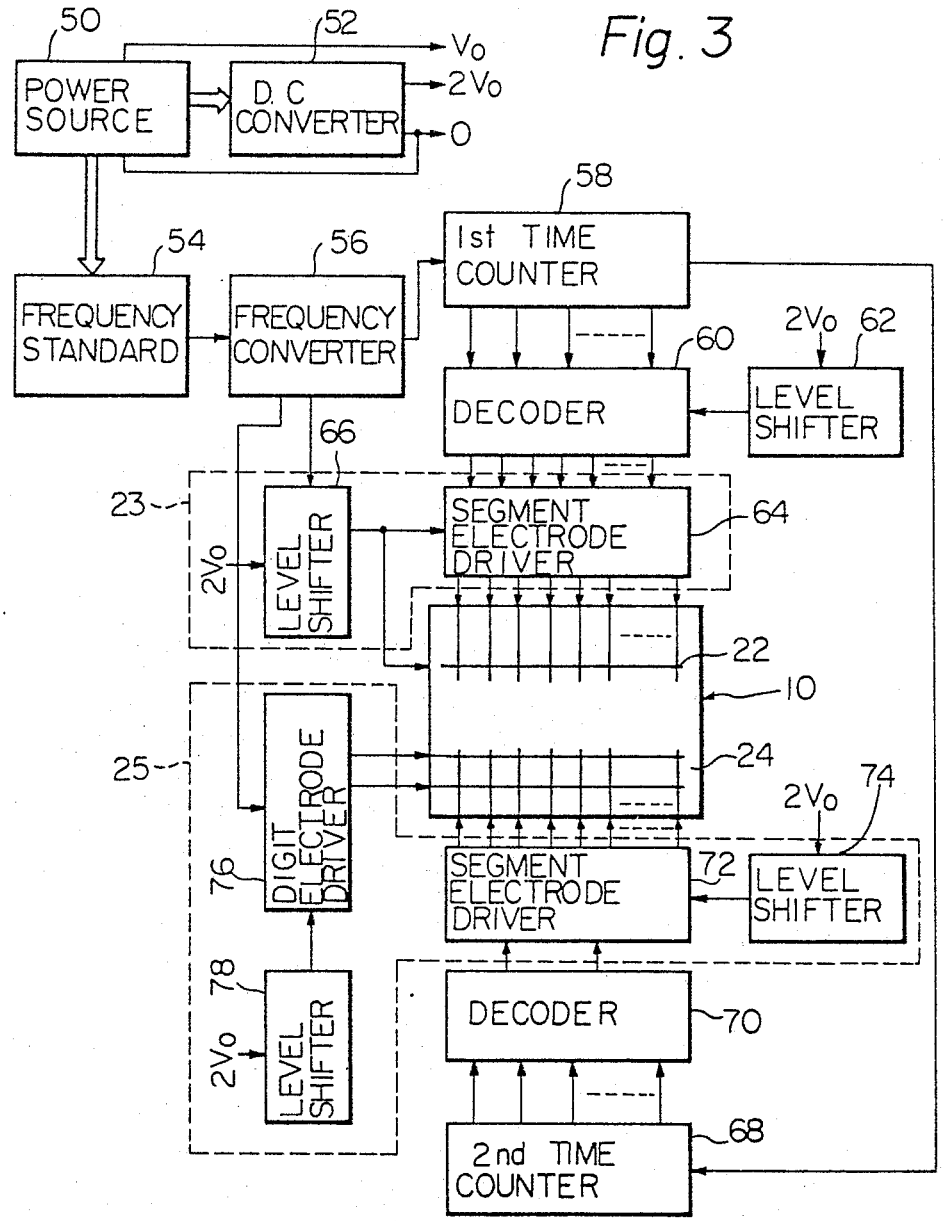
FIG. 3 is a block diagram of a preferred embodiment of an electronic timepiece according to the present invention which utilized the display device shown in FIG. 2.

FIG. 3 illustrates a block diagram of electric circuitry for an electronic timepiece incorporating the drive systems 23 and 25 shown in FIG. 2. The electronic timepiece has a power source 50 such as a battery to provide outputs at 0 volts and Vo volts. A D.C. converter 52 is connected to the power source 50 to provide amplified output voltage at 2 Vo. The power source 50 is connected to a frequency standard 54 provided by a crystal oscillator operating at a frequency of, for example, 32,768 Hz. This relatively high frequency is supplied to a frequency converter 56 in the form of a divider which divides down the frequency from the standard 54 to a lower frequency signal at the final stage of the divider. This lower frequency signal is applied to a first time counter 58 composed of a seconds counter adapted to count the lower frequency signal from the frequency converter 56 to provide a seconds output, a minutes counter coupled to the seconds counter to count the seconds signal to provide a minutes output, and an hours counter adapted to count the minutes output to provide an hours output. Thus, the first time counter 58 is arranged to provide a first time data including, for example, the seconds signal, minutes signal and hours signal. These signals are supplied to a seven segment decoder 60 which will decode or translate the outputs from the first time counter 58 to provide a seven bit binary coded signal as a display data. The binary coded signal has the same potential as the power source output and is amplified by a level shifter 62 in response to the output voltage 2 Vo from the D.C. converter 52. The binary coded signal thus amplified is applied to a segment electrode driver 64 forming part of the static drive system 23, to which a first relatively lower frequency alternating voltage signal of one porality from a level shifter 66 is also applied. The level shifter 66 serves as a means to apply a relatively low frequency alternating voltage signal to the common electrode of the first display section 22. To this end, the level shifter 66 converts the output varying in potential between two levels such as 0 volts and Vo volts to a voltage signal which varies in potential at 0 volts and 2 Vo volts. The segment electrode driver 64 is responsive to the display data signal and the voltage signal to provide a relatively lower frequency, reversed polarity alternating voltage signal. This voltage signal is applied to a selected one of the segment electrodes of the first display section 22, whose common electrode is continuously supplied with the voltage signal from the level shifter 66. As previously noted, the level shifter 66 is coupled to a first intermediate stage of the frequency converter 56 to receive a relatively lower frequency signal therefrom and amplifies the level of the lower frequency signal in response to the output voltage 2 Vo from the D.C. converter 52.

The hours signal from the first time counter 58 is supplied to a second time counter 68 composed of a dates counter adapted to count the hours signal to provide a dates signal, and a months counter adapted to count the dates signal to provide a months signal. The second time counter 68 thus provides a second time data including the dates signal and the months signal, which are supplied to a decoder 70. The decoder 70 decodes each of these signals to provide a two bit binary coded signal. The two bit binary coded signal is applied to a segment electrode driver 72 forming part of the matrix drive system 25 to which an output from a level shifter 74 responsive to the output voltage 2 Vo from the D.C. converter 52 is also applied. The segment electrode driver 72 applies a selected one of first, second, third and fourth alternating voltage signals of equal amplitude level to a selected one of four segment electrodes of the second display section 24.

The matrix drive system 25 also includes a digit electrode driver 76, which is coupled to a second intermidiate stage of the frequency converter 56 to receive a second relatively lower frequency signal therefrom to provide first and second voltage signals which are out of phase from each other and sequentially varies in potential at first, second and third voltage levels. These voltage signals are continuously applied to first and second digit electrodes of the second display section 24. A level shifter 78 is coupled to the digit electrode driver 76 to amplify the level of output signals produced therein.

Figure 4:
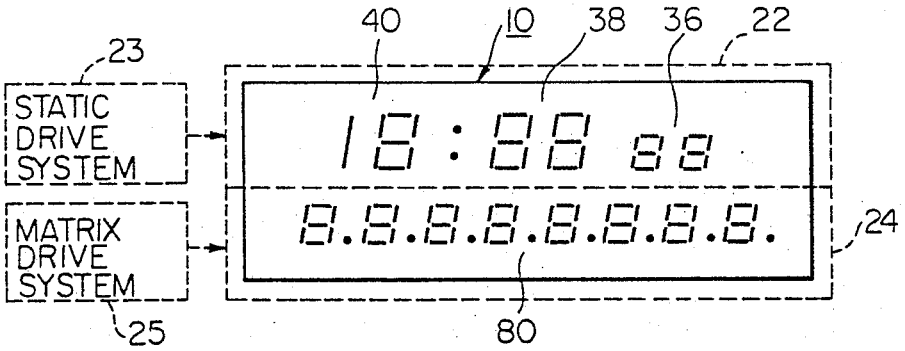
FIG. 4 shows another example of a dispaly surface of the liquid crystal dispaly device shown in FIG. 1.

FIG. 4 shows another example of a display surface for a combination electronic timepiece and electronic calculator with like or corresponding components are designated by the same reference numerals as those used in FIG. 2. This illustrated example differs from the example of FIG. 2 in that the second display section 24 is composed of a calculator display station 80 which is adapted to display the results of mathematical claculations. In the illustrated example of FIG. 4, the first display section 22 composed of the seconds display station 36, the minutes display station 38 and the hours display station 40 is connected to and driven by the static drive system 23. On the other hand, the second display section 24 composed of the calculator display station 80 is connected to and driven by the matrix drive system 25 in the similar manner as already mentioned with reference to FIG. 2.

Figure 5:
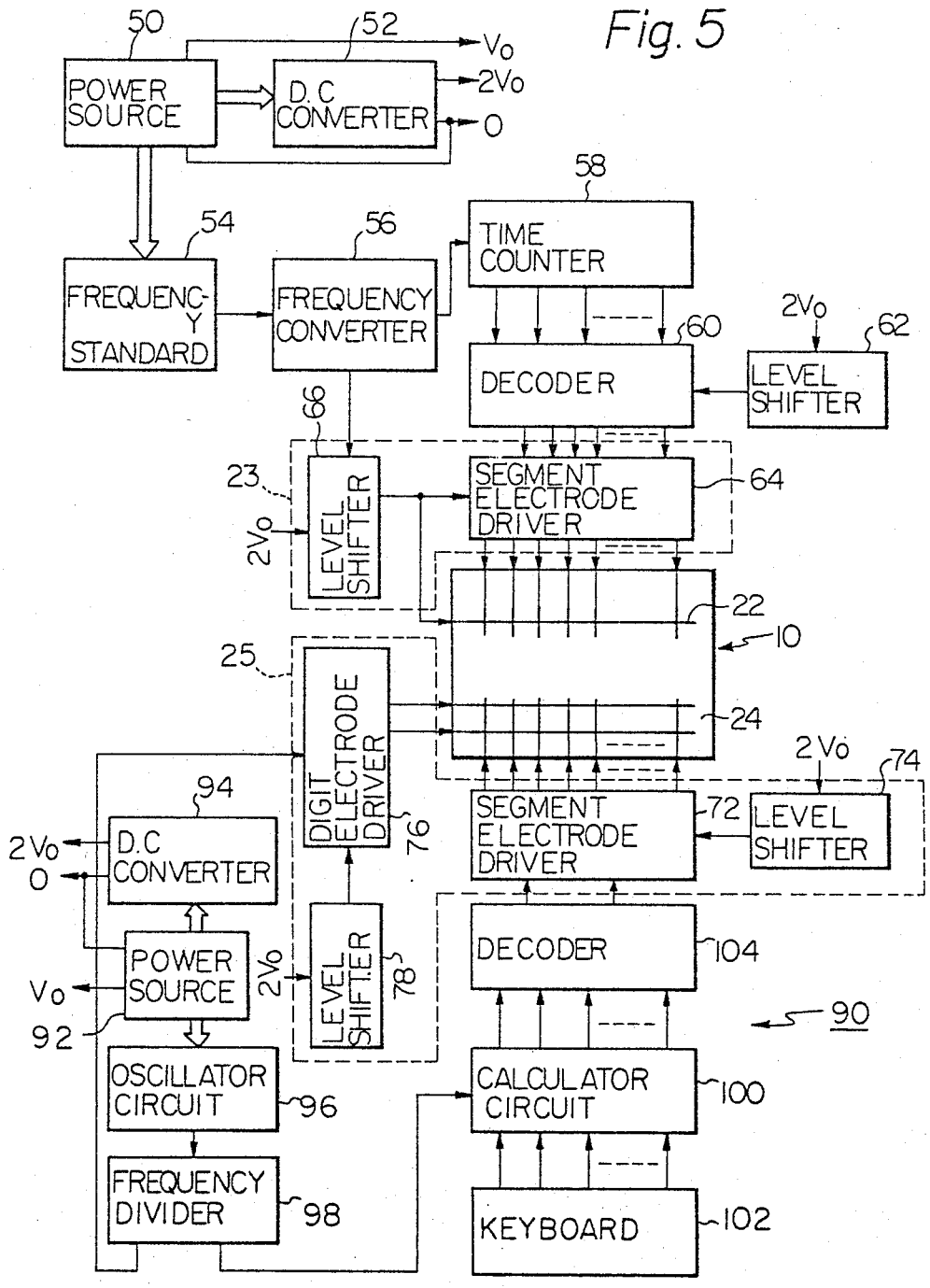
FIG. 5 is a block diagram of another preferred embodiment of an electronic timepiece incroporating a miniaturized electronic calculator and the display device shown in FIG. 4.
Figure 6:
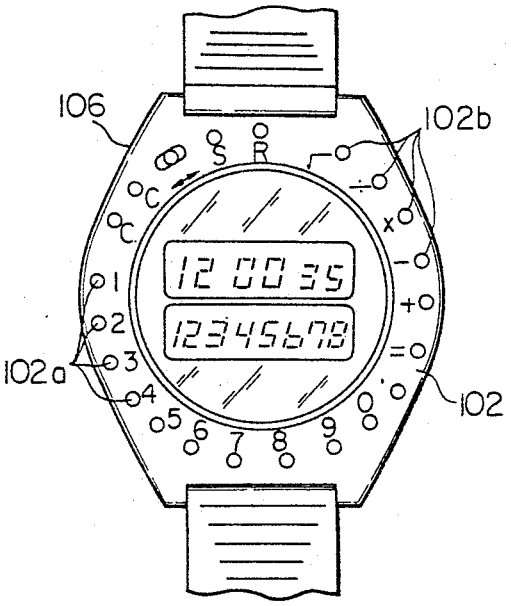
FIG. 6 is a schematic view of a watch case for the electronic timepiece shown in FIG. 5.

FIG. 5 illustrates a block diagram of electric circuitry for a combination electronic timepiece and calculator incorporating the display device shown in FIG. 4 with like parts bearing like reference numerals as those used in FIG. 3. The calculator 90 comprises a power source 92 coupled to a D.C. converter 94, which provides output voltage at 2Vo independently of the D.C. converter 52 of the timing circuit of the electronic timepiece. This output voltage is supplied to the level shifters of the matrix drive system 25. The power source 92 supplies a power to an oscillator circuit 96 composed of a crystal oscillator (not shown) operating at a high frequency. A high frequency signal from the oscillator circuit 96 is supplied to a frequency divider 98, which divides down the high frequency signal to a lower frequency signal. This lower frequency signal is supplied to a calculator circuit 100 in a watch case to which a key board 102 is connected. As shown in FIG. 6, the key board 102 includes a plurality of numeral keys **102*a* and function keys 102*b* which are operatively disposed on circumferentially spaced positions of the watch case 106. Indicated as 102*c* is a mode switch. When the mode switch 102*c* of FIG. 6 is closed, energy is supplied from the power source 92 to the calculator circuit 100 although the connection therebetween is not shown in FIG. 5. The calculator circuit 100 is preferably formed of complementary MOS transistors and is provided with sufficient storage to perform various arithmetic functions such as the addition, subtraction, multiplication and division, etc. The output of the calculator circuit 100 is supplied to decoder 104 which provides a two bit binary coded signal, which is applied to the matrix drive system 25. The matrix drive system 25 is similar in circuit arrangement with that shown in FIG. 3 except that a relatively lower frequency signal is supplied from an intermediate stage of the frequency divider 98 to the digit electrode driver 76 and the level shifters 74 and 78 receives the output voltage from the D.C. converter 94 of the calculator 90, and, therefore, a detailed description of the matrix drive system 25** is herein omitted.

Figure 7:
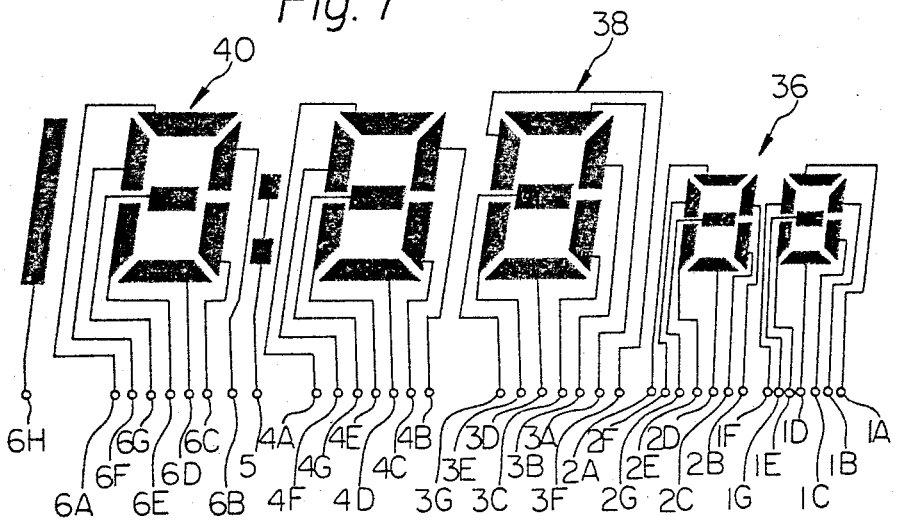
FIG. 7 is a diagrammatic representation of the electrical interconnections of the digit segments for a first display section shown in FIGS. 2 and 4.

FIG. 7 shows a detailed circuit connection for the segment electrodes of each digit of the first display section 22 shown in FIG. 2. Each digit includes seven segment electrodes such as 1A, 1B, 1C, 1D, 1E, 1F and 1G and each also includes a common electrode 1M as shown in FIG. 8, which illustrates an example of a portion of the segment electrode driver 64 forming part of the static drive system 23 shown in FIGS. 3 and 5.

Figure 8:
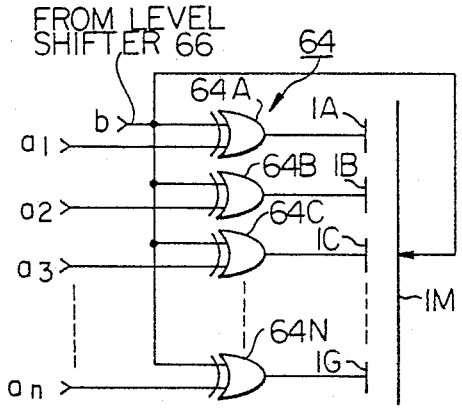
FIG. 8 is a wiring diagram of a portion of a segment electrode driver forming part of a static drive system shown in FIGS. 3 and 5.
Figure 9:
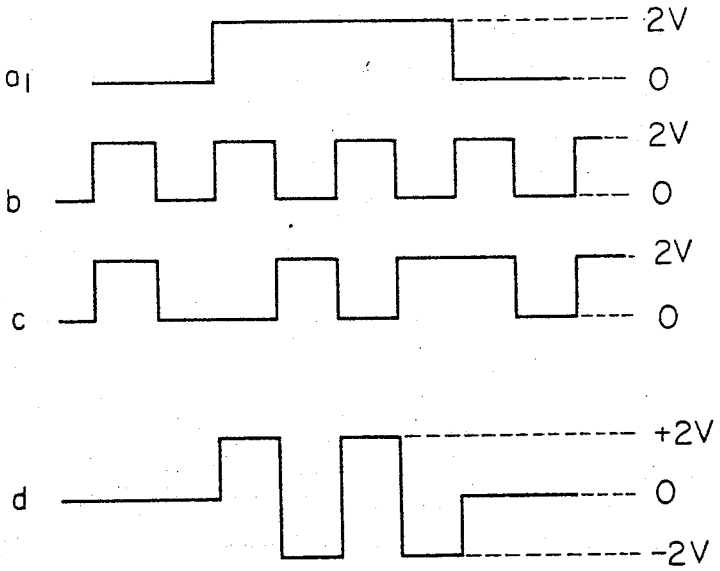
FIG. 9 is a timing chart for illustrating the time relationship of the signals applied to the segment electrodes and the common electrode.

The segment electrode driver 64 comprises EXCLUSIVE OR gates 64A, 64B, 64C... and 64N, each for each segment electrode as shown in FIG. 8. Each EXCLUSIVE OR gate has one input connected to the level shifter 66 (see FIG. 3 or 5) to which the common electrode 1M is also connected, and the other input coupled to the decoder 60 to receive a binary coded signal such as a display data as shown by the waveform $a_1$ in FIG. 9. The level shifter 66 provides an alternating voltage signal which varies in potential between "0" and "2Vo" as shown by the waveform b in FIG. 9. This alternating voltage signal b of one polarity is applied to the one input of each of the EXCLUSIVE OR gates 64A, 64B, 64C... and 64N and to the common electrode 1M. On the other hand, the binary coded signals $a_1$, $a_2$, $a_3$... and $a_n$ are applied to the other inputs of the EXCLUSIVE OR gates 64A, 64B, 64C... and 64N, although only the display data $a_1$ is shown in FIG. 9. Thus, each of the EXCLUSIVE OR gates applies to the segment electrode a reversed polarity alternating voltage signal exclusively of the voltage signal applied to the common electrode or the display data signal. The waveform *d* in FIG. 9 shows the voltage difference across the segment electrode and the common electrode. The voltage difference has a value greater than the threshold voltage level for the light scattering of the liquid crystal and, therefore, a selected one of the segments attains the light scattering state.

Figure 10:
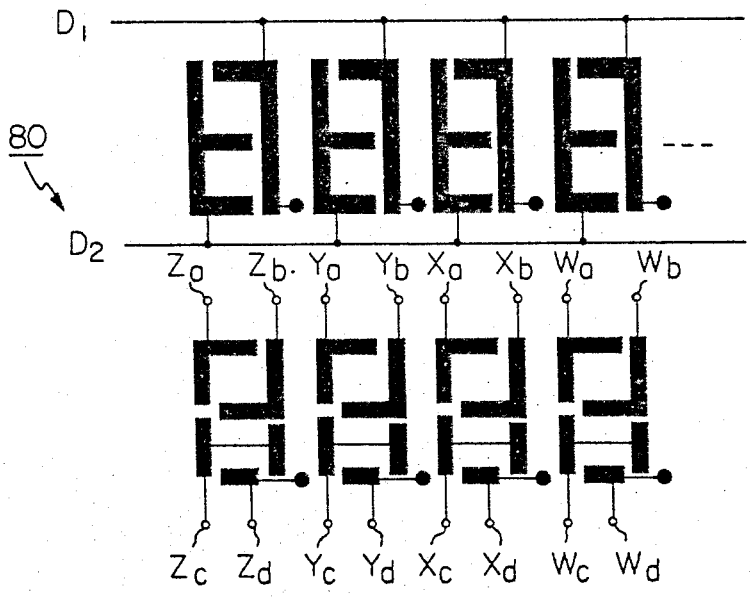
FIG. 10 is a diagrammatic representation of the electrical interconnections for the digit electrodes and the segment electrodes for a second display section shown in FIG. 4.

FIG. 10 shows a detailed circuit connection for the digit electrodes and the segment electrodes of a portion of the second display section 24, i.e., the calculator display station 80 shown in FIG. 4. As shown in FIG. 10, each digit includes four segment electrodes such as *Wa*, *Wb*, *Wc* and *Wd* and each segment electrode has first and second portions disposed opposite the first and second digit electrodes $D_1$ and $D_2$, respectively. It should be noted that the dates display station 42 and the months display station 44 of the second display section of FIG. 2 may be arranged in the same manner as that of FIG. 10.

Figure 11:
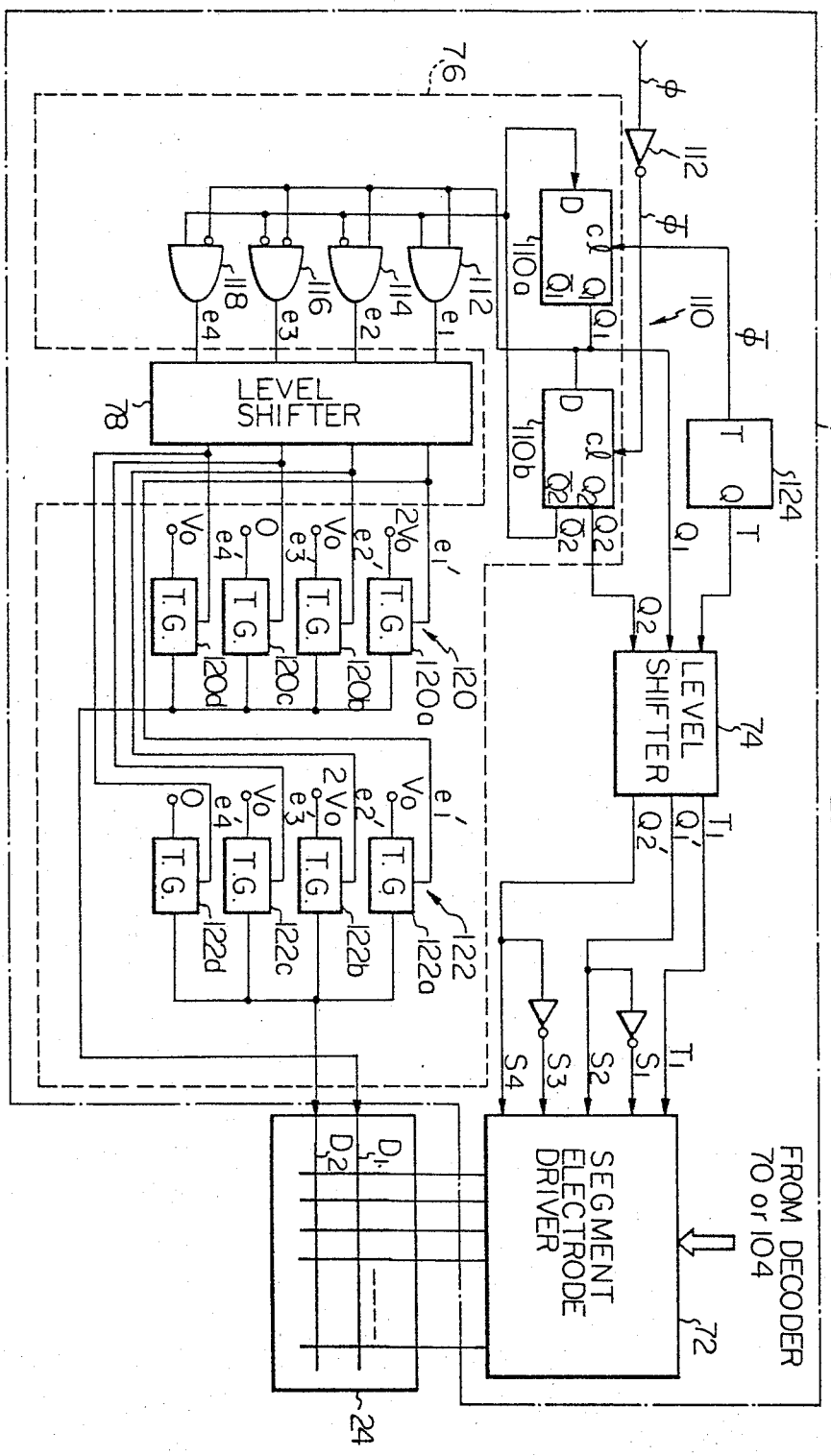
FIG. 11 is a detailed block diagram of a preferred example of the matrix drive system shown in FIGS. 3 and 5.
Figure 12:
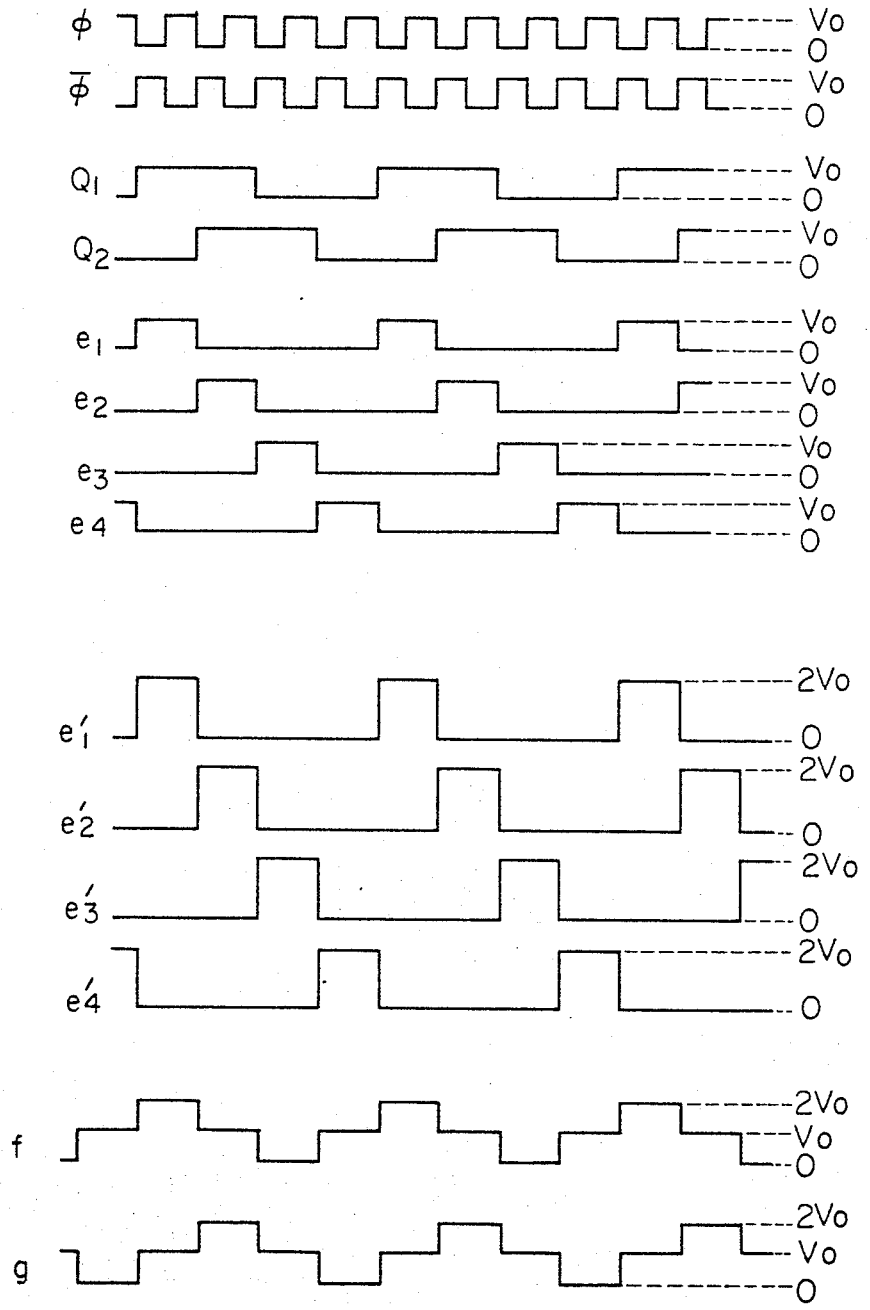
FIG. 12 is a timing chart for illustrating the operation of the circuit shown in FIG. 11.

FIG. 11 illustrates a block diagram of the matrix drive system 25 shown in FIGS. 3 and 5. In FIG. 11, the digit electrode driver 76 of the matrix drive system 25 includes a signal generator 110 composed of first and second data-type flip-flops 110*a* and 110*b* having their clock input terminals adapted to receive a relatively lower frequency signal $\phi$ via an inverter 112 from the frequency converter 56 or the frequency divider 98 shown in FIGS. 3 or 5. The $Q_1$ output of the first data-type flip-flop 110*a* is coupled to the data input terminal of the second data-type flip-flop 110*b* whose $\overline{Q}_2$ output is fed back to the data input terminal of the first data-type flip-flop 110*a*. The first and second data-type flip-flops 110*a* and 110*b* produce output signals as shown by the waveforms $Q_1$ and $Q_2$ in FIG. 12, respectively. The output signal $Q_1$ and the inverse of the output signal $Q_2$ are applied to each of gates 112, 114, 116 and 118. These gates produce outputs $e_1$, $e_2$, $e_3$ and $e_4$ which sequentially vary in phase from each other and which vary in potential between two levels such as 0 and Vo as shown in FIG. 12. These outputs are applied to the level shifter 78, which provides outputs $e_1'$,$e_2'$,$e_3'$ and $e_4'$, varying in potential between 0 and 2 Vo as shown in FIG. 12. The outputs $e_1'$, $e_2'$, $e_3'$ and $e_4'$ are applied in parallel to control terminals of a first group 120 of tranmission gates 120*a*, 120*b*, 120*c* and 120*d* and control terminals of a second group 122 of transmission gates 122*a*, 122*b*, 122*c* and 122*d*, respectively. Each of the transmission gates comprises an n-type metal oxide semiconductor (MOS) transistor having its gate terminal serving as the control terminal and a p-type MOS transistor having its gate terminal coupled via an inverter to the gate terminal of the n-type MOS transistor. The source terminals of the n-type and p-type MOS transistors are connected together and serve as an input terminal which is adapted to receive a selected one of three output voltages, i.e., "0", "Vo" and "2 Vo". The drain terminals of the n-type and p-type MOS transistors are coupled together and serve as an output terminal.

As shown in FIG. 11, the input terminals of the transmission gates 120*a*, 120*b*, 120*c* and 120*d* are labelled as "2 Vo", "Vo", "0" and "Vo", respectively, so that when control inputs $e_1'$, $e_2'$, $e_3'$ and $e_4'$ attain a positive level, output pulses at varying potentials such as 2 Vo, Vo, 0 and Vo appear on the output terminals of the transmission gates 120*a*, 120*b*, 120*c* and 120*d*, respectively. The output terminals of the transmission gates 120*a*, 120*b*, 120*c* and 120*d* are coupled together and connected to the first digit electrode $D_1$ to apply thereto a first voltage signal which sequentially varies in potential at first, second and third levels such as 0, Vo and 2 Vo as shown by the waveform *f* in FIG. 12. Likewise, the input terminals of the transmission gates 122*a*, 122*b*, 122*c* and 122*d* are labelled as "Vo", "2 Vo", "Vo" and "0", respectively, so that when control inputs $e_1'$, $e_2'$, $e_3'$ and $e_4'$ attain a positive level outputs at varying potentials such as Vo, 2 Vo, Vo and 0 appear on the output terminals of the transmission gates 122*a*, 122*b*, 122*c* and 122*d*, respectively. These output terminals are coupled to the second digit electrode $D_2$ to apply thereto a second voltage signal varying in potential as shown by the waveform g in FIG. 12. In this manner, the first and second digit electrodes $D_1$ and $D_2$ are applied with the first and second voltage signals which are out of phase from each other by a predetermined time interval.

Figure 14:
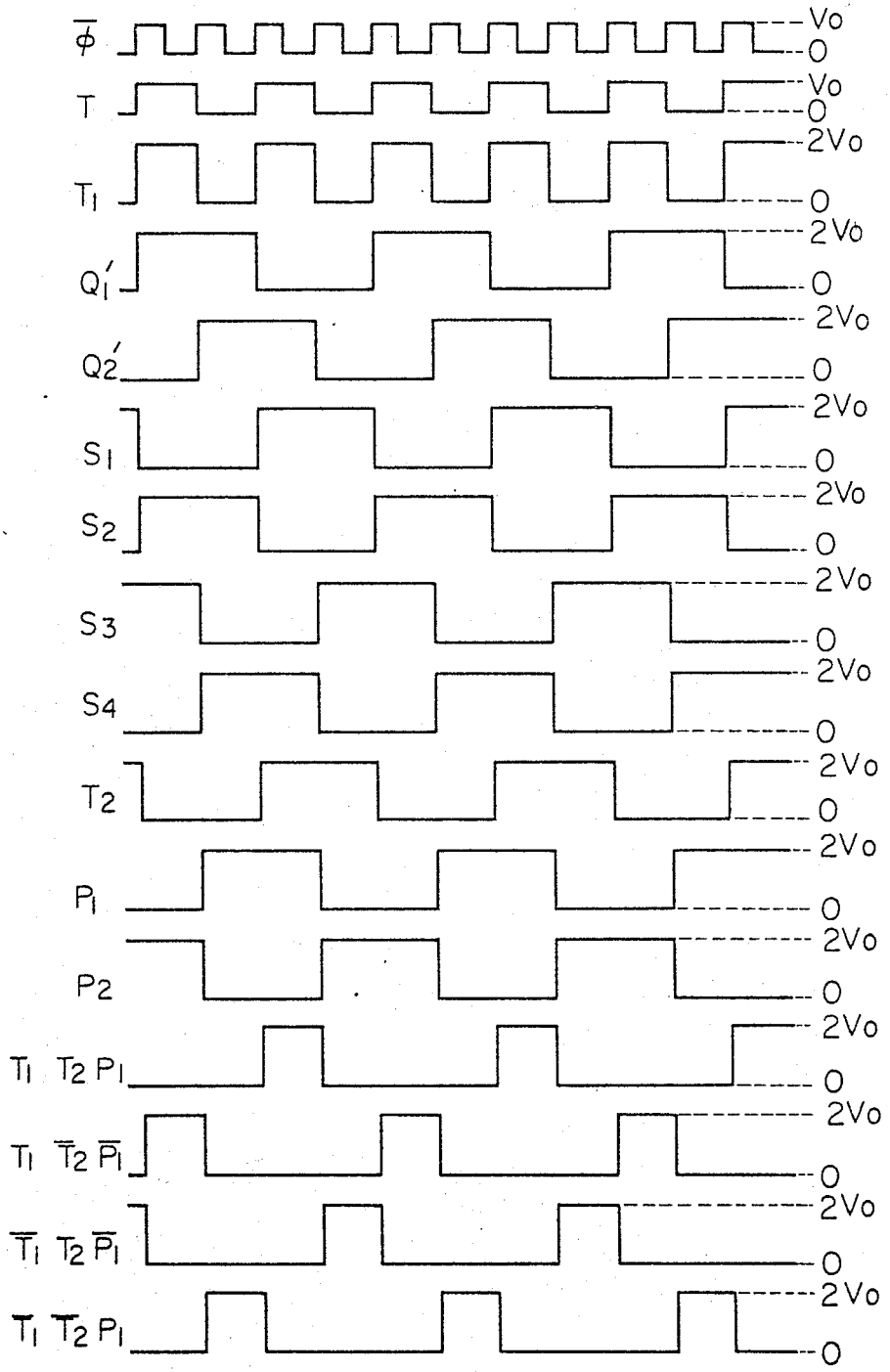
FIGS. 14 and 15 are timing charts for illustrating the operation of the circuits shown in FIGS. 11 and 13.

The inverted higher frequency signal $\overline{\phi}$ is also applied to a divide by 2 counter 124, which generated an output as shown by the waveform T in FIG. 14. This output T is higher in frequency than the signals $Q_1$ and $Q_2$ and applied to the level shifter 74, to which the outputs $Q_1$ and $Q_2$ are also applied. The level shifter 74 amplifies the level of the inputs T, $Q_1$ and $Q_2$ to provide output $T_1$, $Q_1'$ and $Q_2'$. The output $T_1$ is applied as an input to the segment electrode driver 72, to which inputs $S_1$, $S_2$, $S_3$ and $S_4$ are also applied. The input $S_1$ is the inverse of the output $Q_1'$ as shown in FIG. 14, and the input $S_2$ is identical to the output $Q_1'$. The input $S_3$ is the inverse of the output $Q_2'$, and the input $S_4$ is identical to the output $Q_2'$.

Figure 13:
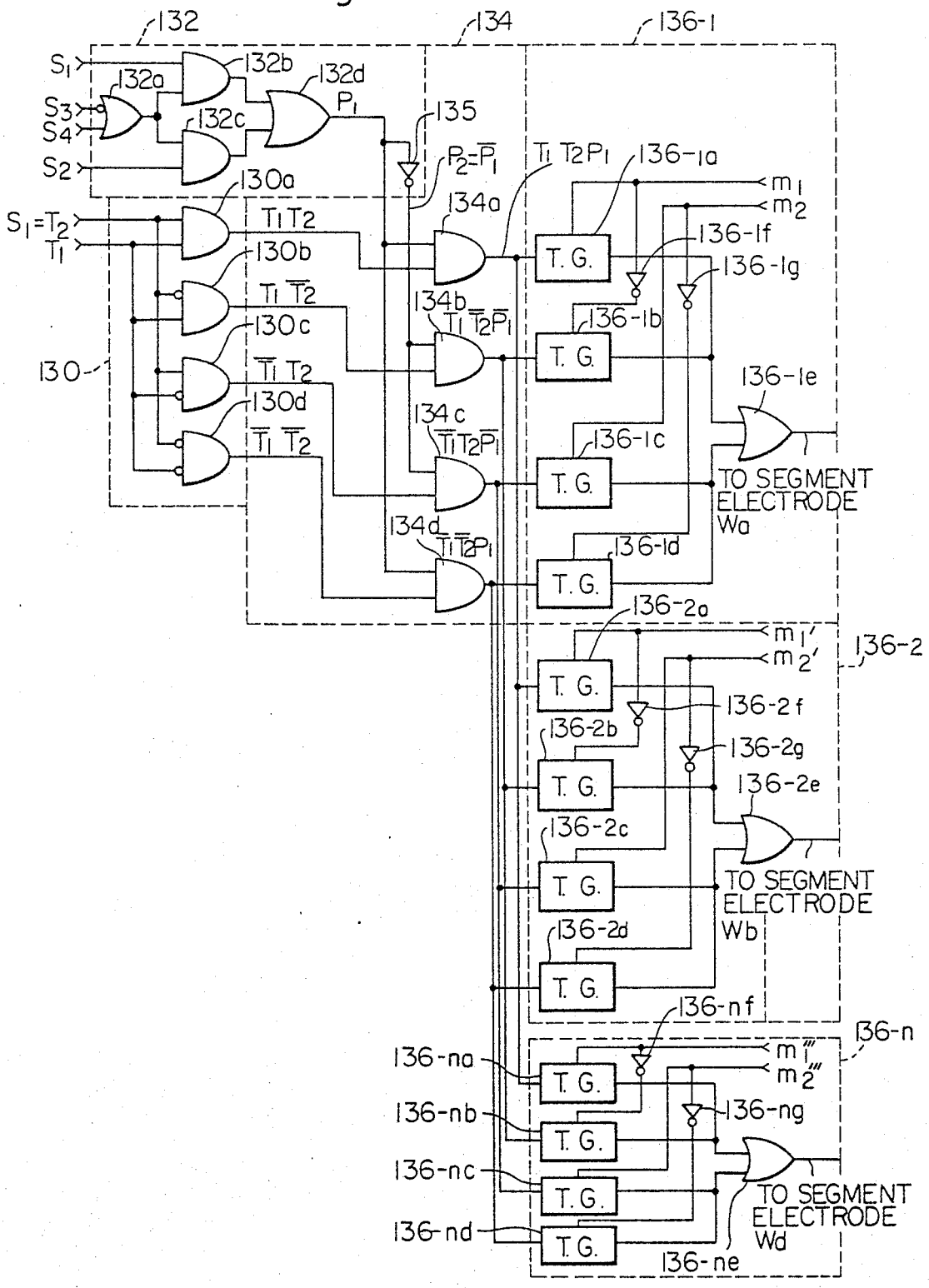
FIG. 13 is a preferred example of a segment electrode driver shown in FIG. 11.

FIG. 13 shows an example of a portion of the segment electrode driver 72. As shown, the segment electrode driver 72 comprises a first signal generator 130 responsive to the signals $S_1$ and $T_1$ to generate first, second, third and fourth pulse signals at a frequency equal to that of the signal $S_1$ and having the duration smaller than that of the signal $S_1$. To this end, the first signal generator 130 is composed of AND gates 130*a*, 130*b* and 130*c*, and a NAND gate 130*d*. The AND gate 130*a* has one input coupled to receive the signal $S_1$ as a signal $T_2$ and the other input coupled to receive the signal $T_1$ to generate a first output signal, labelled $T_1\overline{T}_2$. The AND gate has one inverted input coupled to receive the signal $T_2$ and the other input coupled to receive the signal $T_1$ to generate a second output signal, labelled $T_1T_2$. The NAND gate 130*c* has one input coupled to receive the signal $T_2$ and the other inverted input coupled to receive the signal $T_1$ to generate a third output signal, labelled $\overline{T}_1T_2$. The NAND gate 130*d* has one input coupled to receive the signal $T_2$ and the other input coupled to receive the signal $T_1$ to generate a fourth output signal, labelled $\overline{T}_1\overline{T}_2$.

The segment electrode driver 72 also includes a second signal generator 132 composed of an OR gate 132*a*, AND gates 132*b* and 132*c*, and an OR gate 132*d*. The OR gate 132*a* has one inverted input adapted to receive the signal $S_3$ and the other input adapted to receive the signal $S_4$, and has its output coupled to one input of each of the AND gates 132*b* and 132*c*. The other inputs of the AND gates 132*b* and 132*c* are coupled to receive the signals $S_1$ and $S_2$, respectively. The outputs of the AND gates 132*b* and 132*c* are coupled in inputs of the OR gate 132*d*, which generates an output as shown by the waveform $P_1$ in FIG. 14. The output $P_1$ and an output $P_2$ which is the inverse of the output $P_1$ are applied to a third signal generator 134. The third signal generator 134 comprises AND gates 134*a*, 134*b*, 134*c* and 134*d*. The AND gate 134*a* has one input coupled to the output of the OR gate 132*d* and the other input coupled to the output of the AND gate 130*a* to generate an output $T_1T_2P_1$. The AND gate 134*b* has one input coupled the output of an inverter 135 and the other input coupled to the output of the AND gate 130*b* to generate an output $T_1\overline{T}_2\overline{P}_1$. The AND gate 134*c* has one input coupled to the output of the inverter 135 and the other input coupled to the output of the AND gate 130*c* to generate an output $\overline{T}_1T_2\overline{P}_1$. The AND gate 134*d* has one input coupled to the output of the OR gate 132*d* and the other input coupled to the output of the NAND gate 130*d* to generate an output $\overline{T}_1\overline{T}_2P_1$. The outputs $T_1T_2P_1$, $T_1\overline{T}_2\overline{P}_1$, $\overline{T}_1T_2\overline{P}_1$, and $\overline{T}_1\overline{T}_2P_1$ are applied in parallel to synthesizers 136-1, 136-2 ... and 136-*n* having their outputs coupled to the segment electrodes such as W*a*, W*b*, W*c* and W*d* (see FIG. 10), respectively. The synthesizer 136-1 comprises a switching means for passing therethrough a selected combination of outputs $T_1T_2P_1$, $T_1\overline{T}_2\overline{P}_1$, $\overline{T}_1T_2\overline{P}_1$ and $\overline{T}_1\overline{T}_2P_1$ in response to control signals applied thereto. To this end, the switching means includes first, second, third and fourth transmission gates, 136-1*a*, 136-1*b*, 136-1*c* and 136-1*d*, whose input terminals are coupled to the outputs of the AND gates 134*a*, 134*b*, 134*c* and 134*d*, respectively. The output terminals of the first and second transmission gates 136-1*a* and 136-1*b* are coupled to one input of an OR gate 136-1*e* serving as a summing gate, to the other input of which is coupled the output terminals of the third and fourth transmission gates 136-1*c* and 136-1*d*. The first transmission gate 136-1*a* has its control terminal coupled to receive a binary coded signal $m_1$ as a control input from the decoder 70 or 104 (see FIGS. 3 or 5). The second transmission gate 136-1*b* has its control terminal coupled to receive the control input $m_1$ through an inverter 136-1*f*. The third transmission gate 136-1*c* has its control input coupled to receive a binary coded signal $m_2$ as a control input from the decoder. The fourth transmission gate 136-1*d* has its control terminal coupled to receive the control input $m_2$ through an inverter 136-1*g*. It should be noted that each transmission gate may be of the type previously stated and conductive when the control input is at high level and non-conductive when the control input becomes low level.

Figure 15:
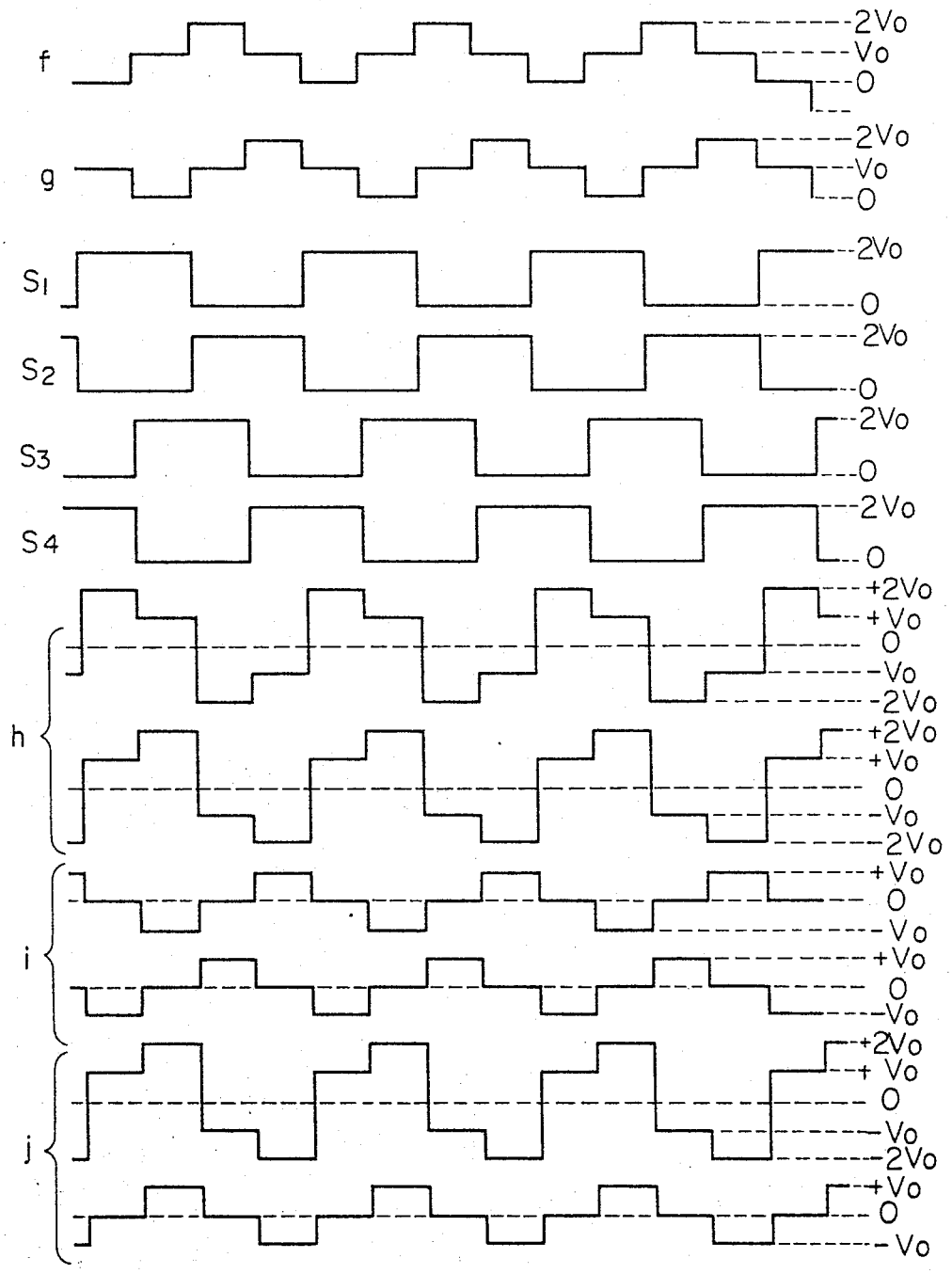

When both of the control inputs $m_1$ and $m_2$ from the decoder are at high level, the first and third transmission gates 136-1*a* dnd 136-1*c* are rendered conductive. In this condition, the outputs $T_1T_2P_1$ and $\overline{T}_1T_2\overline{P}_1$ are applied through the first and third transmission gates 136-1*a* and 136-1*c* to the inputs of the summing gate 136-1*e* which consequently produces an output identical to the signal $S_1$ as will be understood from FIG. 14. This output is applied to the segment electrode W*a* (see FIG. 10) while, at this time, the voltage signals *f* and *g* are applied to the digit electrodes $D_1$ and $D_2$ of the second display section. In this instance, the voltage potentials applied across the digit electrode $D_1$ and the segment electrode W*a* and the digit electrode $D_2$ and the segment electrode W*a* exist as shown by the waveforms *h* is FIG. 15. Thus, two segments associated with the segment electrode W*a* attain the light scrattering state.

When the control input $m_1$ is at high level and the control input $m_2$ changes from a low to a high level, the transmission gates 136-1*a* and 136-1*d* are conductive, and the outputs $T_1T_2p_1$ and $\overline{T}_1\overline{T}_2P_1$ are applied to the inputs of the OR gate 136-1*e*, respectively. In this condition, the OR gate 136-1*e* produces an output identical to the signal $S_4$, which is applied to the segment electrode W*a*. Thus, the potentials across the electrodes vary as shown by the waveform *j* in FIG. 15. Consequently, the first portion of the segment electrode W*a* disposed opposite the digit electrode $D_1$ remain in the light scattering state, whereas the other second portion of the segment electrode W*a* attains the light transparent state.

When the control input $m_1$ changes from a high to a low level while the control input $m_2$ is at high level, the transmission gates 136-1*b* and 136-1*c* are conductive so that the outputs $T_1\overline{T}_2\overline{P}_1$ and $\overline{T}_1T_2\overline{P}_1$ are applied to the inputs of the OR gate 136-1*e*. In this instance, the OR gate 136-1*e* produces an output identical to the signal $S_3$, and the second portion of the segment electrode W*a* disposed opposite the digit electrode $D_2$ remain in the light scattering state while the first portion attains the light transparent state.

When the control inputs $m_1$ and $m_2$ change from a high to a low level, the transmission gate 136-1*b* and 136-1*d* are rendered conductive to pass the outputs $T_1\overline{T}_2\overline{P}_1$ and $\overline{T}_1\overline{T}_2P_1$ to the inputs of the OR gate 136-1*e*. In this case, the OR gate 136-1*e* produces an output identical to the signal $S_2$. This output $S_2$ is applied to the segment electrode W*a*. The voltage potentials across the segment electrode W*a* and the digit electrodes $D_1$ and $D_2$ vary as shown by the waveform *i* in FIG. 5. Thus, the first and second portion of the segment electrode W*a* attain the light transparent state.

It will thus be seen that when each of the control input $m_1$, $m_1$, . . . and $m_1'''$ is at high plevel the first portion of the segment electrode associated with the digit electrode $D_1$ attain the light scattering state and when each of the control inputs $m_2$, $m_2'$. . . and $m_2'''$ is at high levelthe second portion of the segment electrode associated with the digit electrode $D_2$ attain the light scattering state.

The relationship between the vinary coded signals from the decoder for each of the segment electrodes and the displayed data is exemplified in the following truth table:

Table

| Displayed Date | Wa | | Wb | | Wc | | Wd | |
|---|---|---|---|---|---|---|---|---|
| | $m_1$ | $m_2$ | $m_1'$ | $m_2'$ | $m_1''$ | $m_2''$ | $m_1'''$ | $m_2'''$ |
| 0 | H | H | H | L | H | H | * | H |
| 1 | L | L | H | L | H | L | * | L |
| 2 | H | L | H | H | L | H | * | H |
| 3 | H | L | H | H | H | L | * | H |
| 4 | L | H | H | H | H | L | * | L |
| 5 | H | H | L | H | H | L | * | H |
| 6 | H | H | L | H | H | H | * | H |
| 7 | H | L | H | L | H | L | * | L |
| 8 | H | H | H | H | H | H | * | H |
| 9 | H | H | H | H | H | L | * | H |

In the above Table, the symbols W*a*, W*b*, W*c* and W*d* indicate the segment electrodes corresponding to those shown in FIG. 10. The symbols $m_1$ and $m_2$ indicate the control inputs to be applied to the segment electrode W*a*, $m_1'$ and $m_2'$ the control inputs to be applied to the segment electrode W*b*, $m_1''$ and $m_2''$ the control inputs to be applied to the segment electrode W*c*, and $m_1'''$ and $m_2'''$ the control inputs applied to the segment electrode W*d*. The symbols H and L indicate high and low logic levels of the control input and "*" indicates a don't care case.

Figure 16:
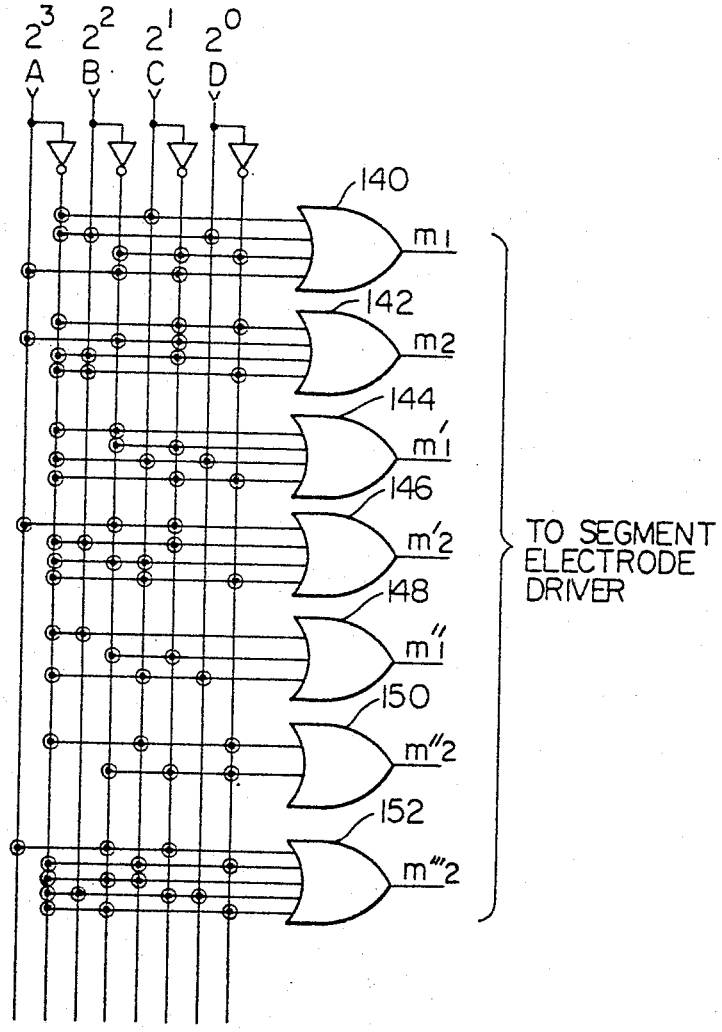
FIG. 16 is a preferred example of a decoder associated with the matrix drive system shown in FIGS. 3 and 5.

FIG. 16 illustrates an example of the decoder 70 or 104 which includes OR gates 140, 142, 144, 146, 148, 150 and 152 adapted to provide outputs $m_1$, $m_2$, $m_1'$, $m_2''$, $m_2''$, $m_1'''$ and $m_2'''$, respectively. As shown, the decoder has inputs terminals adapted to receive output signals A, B, C and D from the second time counter 68 shown in FIG. 3 or from the calculator circuit 100 shown in FIG. 5, representing bit weights of $2^0$, $2^1$, $2^2$ and $2^3$, respectively. The OR gate 140 has a first input adapted to receive the product of signals $\overline{A}$ and C, a second input adapted to receive the product of signals $\overline{A}$, B and D, a third input adapted to receive the product of signals $\overline{B}$, $\overline{C}$ and $\overline{D}$, and a fourth input adapted to receive the product of signals A, $\overline{B}$ and $\overline{C}$. It will thus be seen that a symbol " " indicates an input of an AND gate.

The outputs $m_1$, $m_2$, $m_1'$, $m_2'$, $m_1''$, $m_2''$, $m_1'''$ and $m_2'''$ of the OR gates 140, 142, 144, 146, 148, 150 and 152 are expressed by the following logic equations:

$$m_1 = \overline{A}C + \overline{A}BD + \overline{B}\overline{C}\overline{D} + A\overline{B}\overline{C}$$

$$m_2 = \overline{A}\overline{C}\overline{D} + A\overline{B}\overline{C} + \overline{A}B\overline{C} + \overline{A}B\overline{D}$$

$$m_1' = \overline{A}\overline{B} + \overline{B}\overline{C} + \overline{A}CD + \overline{A}\overline{D}\overline{C}$$

$$m_2' = A\overline{B}\overline{C} + \overline{A}B\overline{C} + \overline{A}\overline{B}C + \overline{A}C\overline{D}$$

$$m_1' = \overline{A}B + \overline{B}\overline{C} + \overline{A}CD$$

$$m_2'' = \overline{B}\overline{C}\overline{D} + \overline{A}C\overline{D}$$

$$m_2''' = A\overline{B}\overline{C} + \overline{A}C\overline{D} + \overline{A}\overline{B}C + \overline{A}B\overline{C}D + \overline{A}\overline{B}\overline{D}$$

Figure 17:
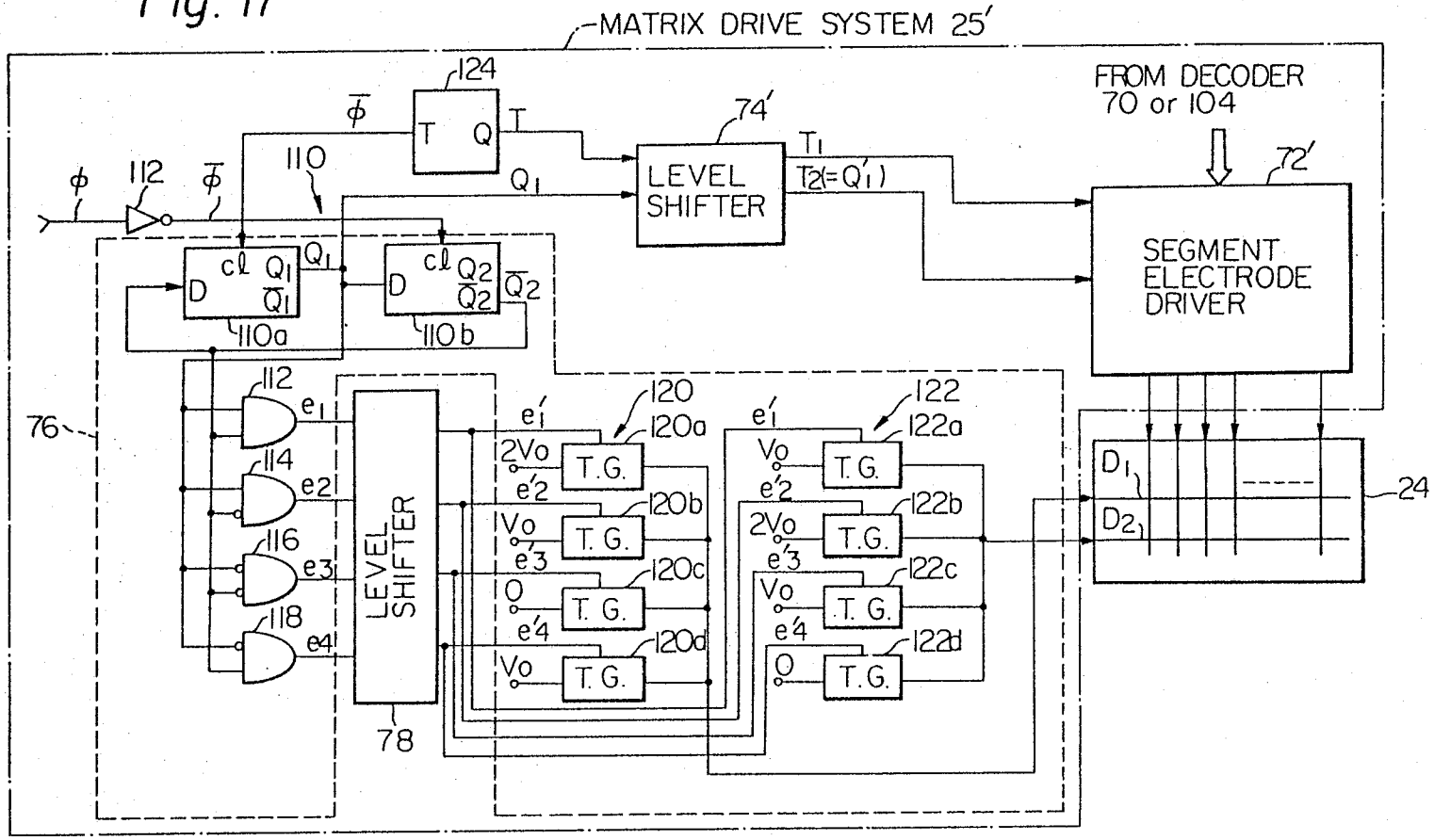
FIG. 17 is a detailed block diagram of another preferred example of the matrix drive system shown in FIG. 11.
Figure 18:
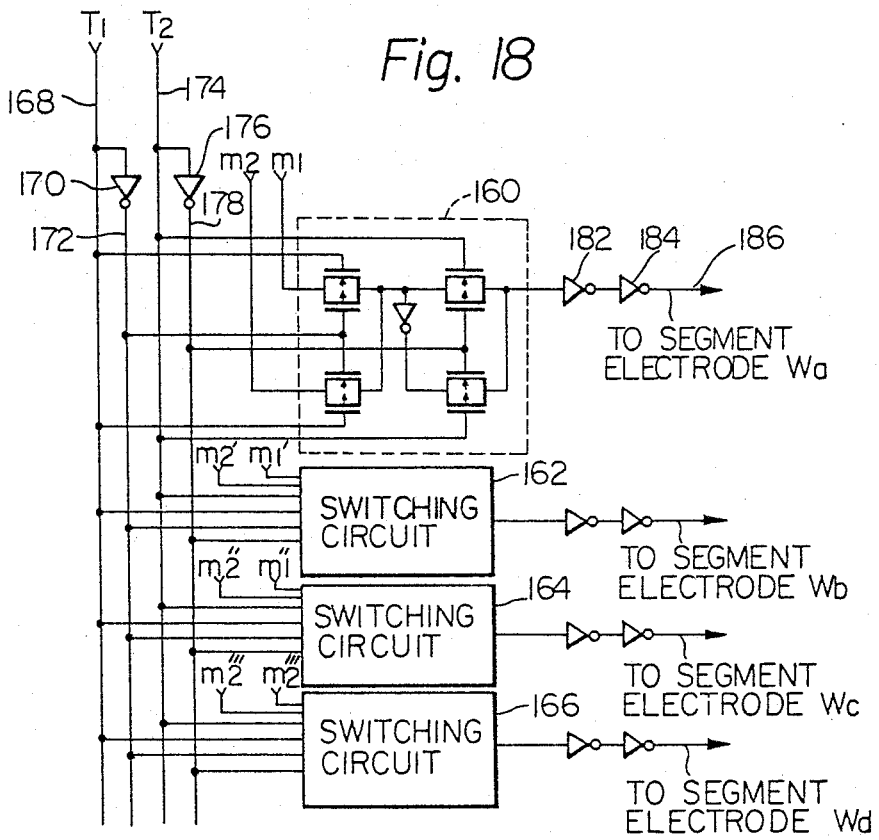
FIG. 18 is a preferred example of the segment electrode driver shown in FIG. 17.

FIG. 17 shows a modified form of the matrix drive system shown in FIG. 11 with the like parts bearing the same reference numerals as those used in FIG. 11 except that a single suffix (') is added to the numerals indicating modified elements. The matrix drive system 25' of FIG. 17 differs from that of FIG. 11 in that the level shifter 74' is arranged to receive the output T of the divide by two counter 124 and the output $Q_1$ of the first data-type flip-flop 110*a* to provide outputs $T_1$ and $T_2$ which is identical to the output $Q_1'$ shown in FIG. 14. These outputs are applied to the segment electrode driver 72'. As shown in FIG. 18, the segment electrode driver 72' comprises switching circuits 160, 162, 164 and 166 each of which includes transmission gates such first, second, third and fourth transmission gates 160*a*, 160*b*, 160*c* and 160*d*. The first transmission gate 160*a* comprises an n-type MOS transistor having its gate terminal coupled to line 168 to receive the output $T_1$ from the level shifter 74', and a p-type MOS transistor having its gate terminal coupled to line 172 to receive the output of an inverter 170 which is the inverse of the output $T_1$. The source terminals of the n-type and p-type MOS transistors of the transmission gate 160*a* are coupled together and connected to receive a signal $m_1$ from the decoder. The second transmission gate 160*b* comprises an n-type MOS transistor having its gate terminal coupled to the gate terminal of the p-type MOS transistor of the first transmission gate 160*a* to which the line 172 is also coupled, and a p-type MOS transistor having its gate terminal coupled to the line 168 to receive the output $T_1$. The source terminals of the n-type and p-type MOS transistors of the second transmission gate 160*b* are coupled together and connected to receive a signal $m_2$ from the decoder. The drain terminals of the first and second transmission gates 160*a* and 160*b* are coupled together and connected to the source terminals of an n-type MOS transistor and a p-type MOS transistor constituting the third transmission gate 160*c*. The drain terminals of the first and second transmission gates 160*a* and 160*b* are also coupled through an inverter 180 to the source terminals of an n-type MOS transistor and a p-type MOS transistor constituting the fourth transmission gate 160*d*. The p-type MOS transistor of the third transmission gate 160*c* has the gate terminal coupled to a line 174 to receive the output $T_2$ while the gate terminal of the n-type MOS transistor is coupled to a line 178 to which the gate terminal of the p-type MOS transistor of the fourth transmission gate 160*d* is also coupled to receive a signal which is the inverse of the output $T_2$. The drain terminals of the n-type and p-type MOS transistors of the third and fourth transmission gates are coupled together and connected via inverters 182 and 184 to a line 186 to which the segment electrode W*a* is connected.

Figure 19:
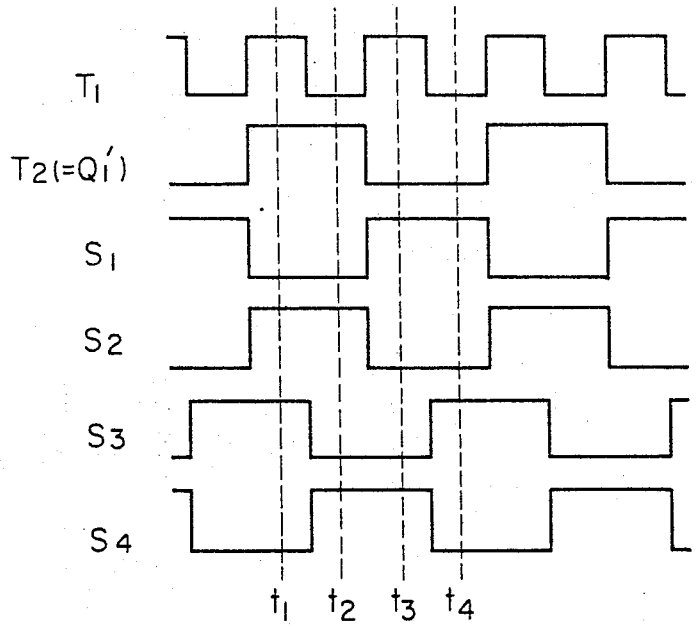
FIG. 19 is a timing chart for illustrating the operation of the circuit shown in FIG. 18.

During the time instant $t_1$, the outputs $T_1$ and $Q_1'$ are at a high logic level as seen in FIG. 19. Consequently, the transmission gates 160*a* and 160*d* are turned ON while the transmission gates 160*b* and 160*c* are turned OFF. During the time instant $t_2$, the output $T_1$ is at a low level and the output $Q_1'$ is at a high level and, therefore, the transmission gates 160*b* and 160*d* are turned ON while the transmission gates 160*a* and 160*c* are turned OFF. During time instant $t_3$, the output $T_1$ is at a high level and the output $Q_1'$ is at a low level and, therefore, the transmission gates 160*a* and 160*c* are turned ON while the transmission gates 160*b* and 160*d* are turned OFF. During time instant $t_4$, the output $T_1$ is at a low level and the output $Q_1'$ is at a low level and, therefore, the transmission gates 160*b* and 160*c* are turned ON while the transmission gates 160*a* and 160*d* are turned OFF.

When the signals $m_1$ and $m_2$ are at a high level during the time interval $t_1$ and $t_4$, an output appearing at line 186 attains low, low, high and high levels at time instant $t_1$, $t_2$, $t_3$ and 4, respectively, as shown by the waveform $S_1$ in FIG. 19. When the signals $m_1$ and $m_2$ are at a low level during the time interval $t_1$ and $t_4$, an output appearing at line 186 attains high, high, low and low level, respectively, as shown by the waveform $S_2$ in FIG. 19. When the signal $m_1$ is at a low level and the signal $m_2$ is at a high level during the time interval $t_1$ and $t_4$, an output appearing at line 186 attains high, low, low and high levels, respectively, as shown by the waveform $S_3$. When the signal $m_1$ is at a high level and the signal $m_2$ is at low level, an output appearing at line 186 attains low, high, high and low levels, respectively, as shown by the waveform $S_4$. As already stated hereinabove, when the signal $S_1$ is applied to the segment electrode W*a*, the first and second portions of the segment electrode associated with the digit electrodes $D_1$ and $D_2$ (see FIG. 10) will attain a light scattering state. The signal $S_2$ will cause the first and second portions of the segment electrode W*a* associated with the digit electrode $D_1$ and $D_2$ to attain a light transparent state. The signal $S_3$ will cause the second portion of the segment electrode W*a* associated with the digit electrode $D_2$ to attain the light scattering state. The signal $S_4$ will cause the first portion of the segment electrode W*a* associated with the digit electrode $D_1$ to attain the light scattering state. The switching circuits 162, 164 and 166 are identical in construction and in operation to the switching circuit 160 and, therefore, a detailed description of the same is herein omitted for the simplicity of description.

Figure 20:
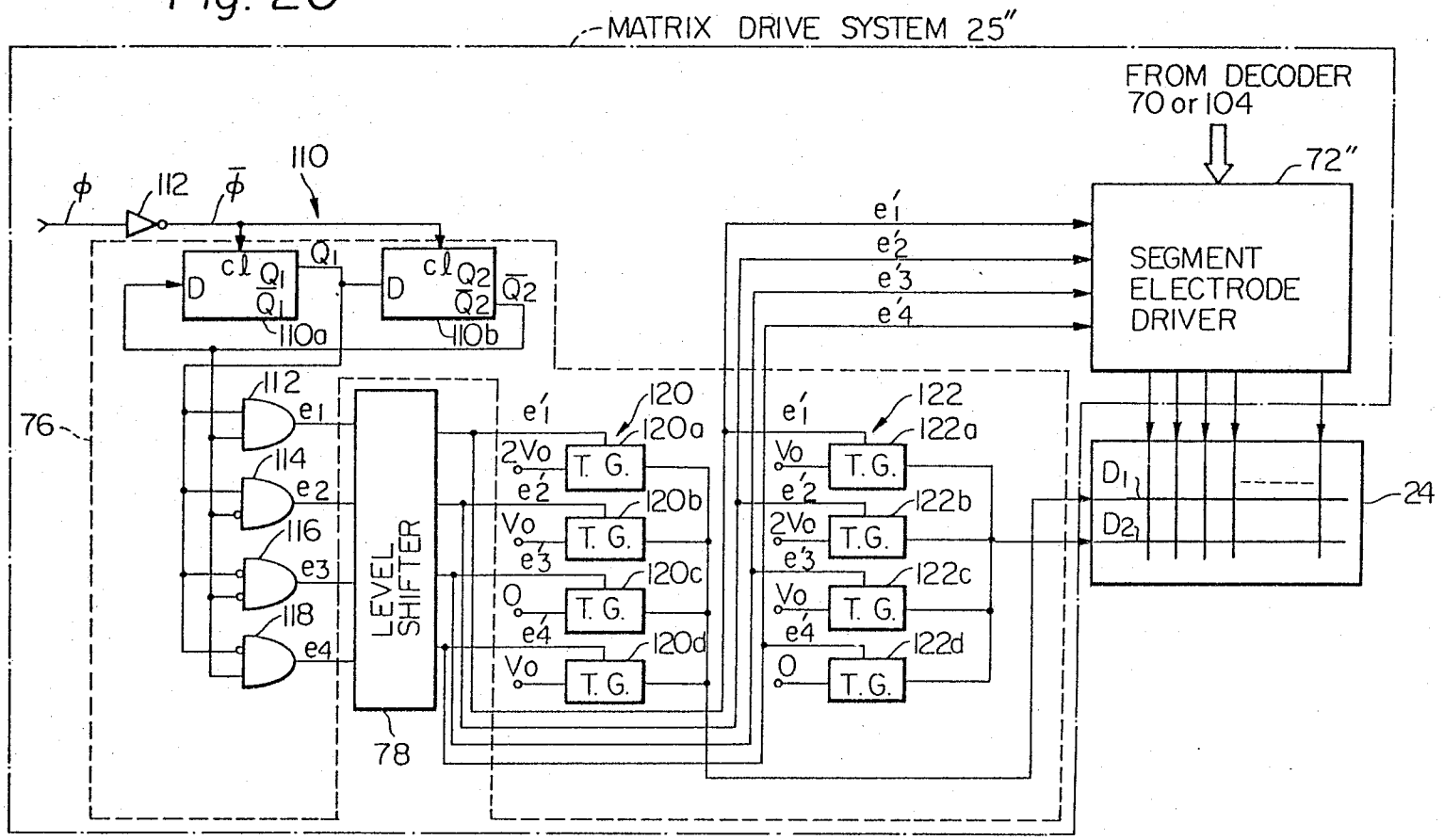
FIG. 20 is a detailed block diagram of still another preferred example of the matrix drive system shown in FIG. 11.
Figure 21:
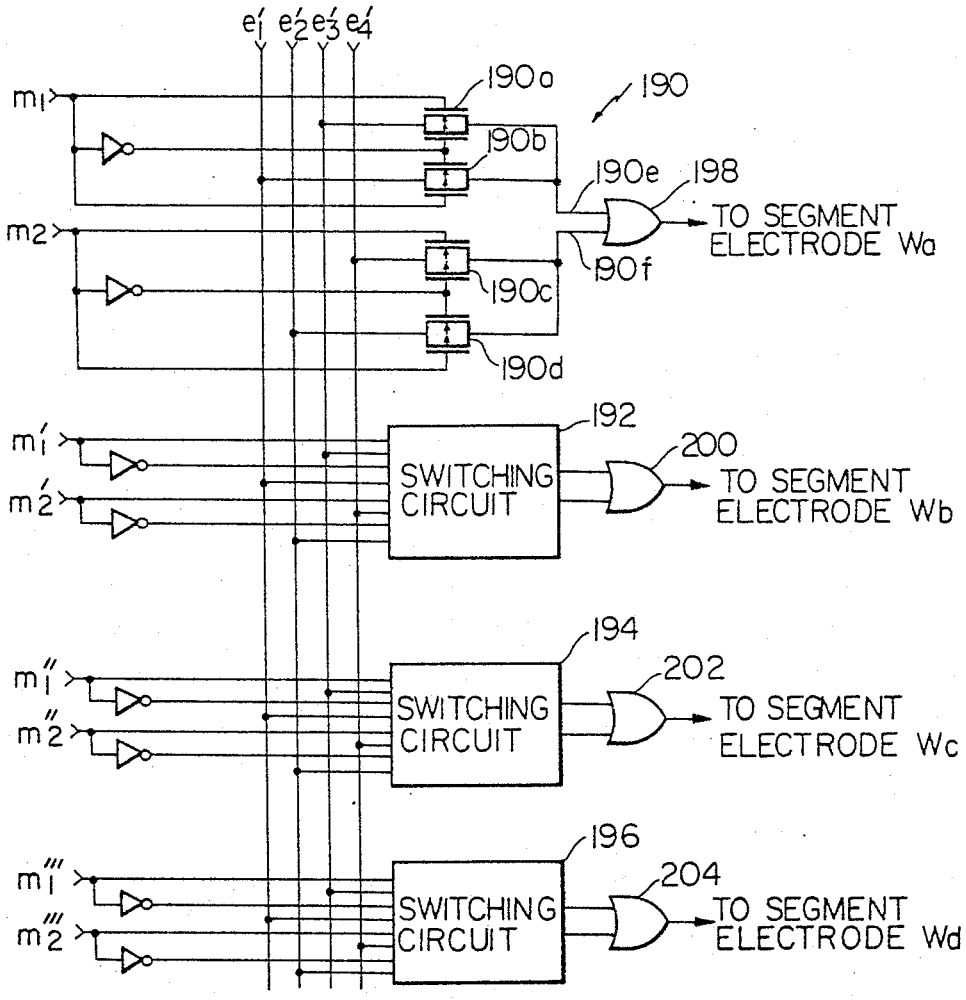
FIG. 21 is a preferred example of the segment electrode driver shown in FIG. 20.

Another modified form of the matrix drive system is shown in FIG. 20, in which like or corresponding component parts are designated by the same reference numerals as those used in FIG. 11 except that a double suffix (″) is added to a modified element. The matrix drive system 25″ differs from that of FIG. 11 in that the segment electrode driver 72″ is arranged to produce output signals $S_1$, $S_2$, $S_3$ and $S_4$ based on a selected combination of the signals $e_1'$, $e_2'$, $e_3'$ and $e_4'$. A preferred example of the segment electrode driver 72″ is shown in FIG. 21. As shown, the segment electrode driver 72″ comprises switching circuits 190, 192, 194 and 196 having their outputs coupled through OR gates 198, 200, 202 and 204 to the segment electrodes W*a*, W*b*, W*c* and W*d*, respectively. Each of the switching circuits comprises first, second, third and fourth transmission gates such as transmission gates 190*a*, 190*b*, 190*c* and 190*d*. The first transmission gate 190*a* has its control terminal coupled to the decoder to receive the signal $m_1$, its input terminal coupled to the level shifter 78 to receive the signal $e_4'$, and its output coupled to one input of the OR gate 198, to which the output of the transmission gate 190*b* is also connected. The second transmission gate 190*b* has its control terminal adapted to receive a signal which is the inverse of the signal $m_1$, and its input terminal coupled to receive the signal $e_1'$. The third transmission gate 190*c* has its control terminal coupled to the decoder to receive the signal $m_2$, its input terminal adapted to receive the signal $e_4'$, and its output coupled to the other input of the OR gate 198 to which the output of the fourth transmission gate 190*d* is also coupled. The fourth transmission gate 190*d* has its control terminal adapted to receive a signal which is the inverse of the signal $m_2$, and its input terminal coupled to receive the signal $e_2'$.

If the signals $m_1$ and $m_2$ from the decoder are at a high level, the first transmission gate 190*a* is turned ON and the second transmission gate 190*b* is turned OFF so that the signal $e_3'$ is passed to line 190*e*. At the same time, the third transmission gate 190*c* is turned ON and the fourth transmission gate 190*d* is turned OFF so that the signal $e_4'$ is passed to line 190*f*. The signals $e_3'$ and $e_4'$ are passed to the OR gate 198, which consequently produces an output which is the sum of the signals $e_3'$ and $e_4'$ and which is identical to the signal $S_1$ shown in FIG. 14. In this instance, the first and second portions of the segment electrode W*a* associated with the digit electrodes $D_1$ and $D_2$ attain a light scattering state.

If the signals $m_1$ and $m_2$ from the decoder are at a low level, the second and fourth transmission gates 190*b* and 190*d* are turned ON while the first and third transmission gates 190*a* and 190*c* are turned OFF. Consequently, the signal $e_1'$ is passed to the line 190*e* while the signal $e_2'$ is passed to the line 190*f*. Thus, the signals $e_1'$ and $e_2'$ are applied to the OR gate 198, which produces an output identical to the signal $S_2$ shown in FIG. 2. This output causes the first and second portions of the segment electrode W*a* associated with the digit electrodes $D_1$ and $D_2$ to attain a light transparent state.

If the signal $m_1$ is at a low level and the signal $m_2$ is at a high level, the second and third transmission gates 190*b* and 190*c* are turned ON and the first and fourth transmission gates 190*a* and 190*d* are turned OFF. In this condition the signals $e_1'$ and $e_4'$ are applied to the OR gate 198 which produces an output identical to the signal $S_3$. This output causes the second portion of the segment electrode W*a* associated with the digit electrode $D_2$ to attain a light scattering state.

If the signal $m_1$ is at a high level and the signal $m_2$ is at a low level, the first and fourth transmission gates 190*a* and 190*d* are turned ON and the second and third transmission gates 190*b* and 190*c* are turned OFF. In this condition, the signals $e_2'$ and $e_3'$ are applied to the OR gate 198 which produces an output identical to the signal $S_4$ shown in FIG. 14. This output causes the first portion of the segment electrode W*a* associated with the digit electrode $D_1$ to attain a light scattering state.

The switching circuits 192, 194 and 196 will operate in the same manner as the switching circuit 190 and, therefore, a detailed description of the same is herein omitted.

Figure 22:
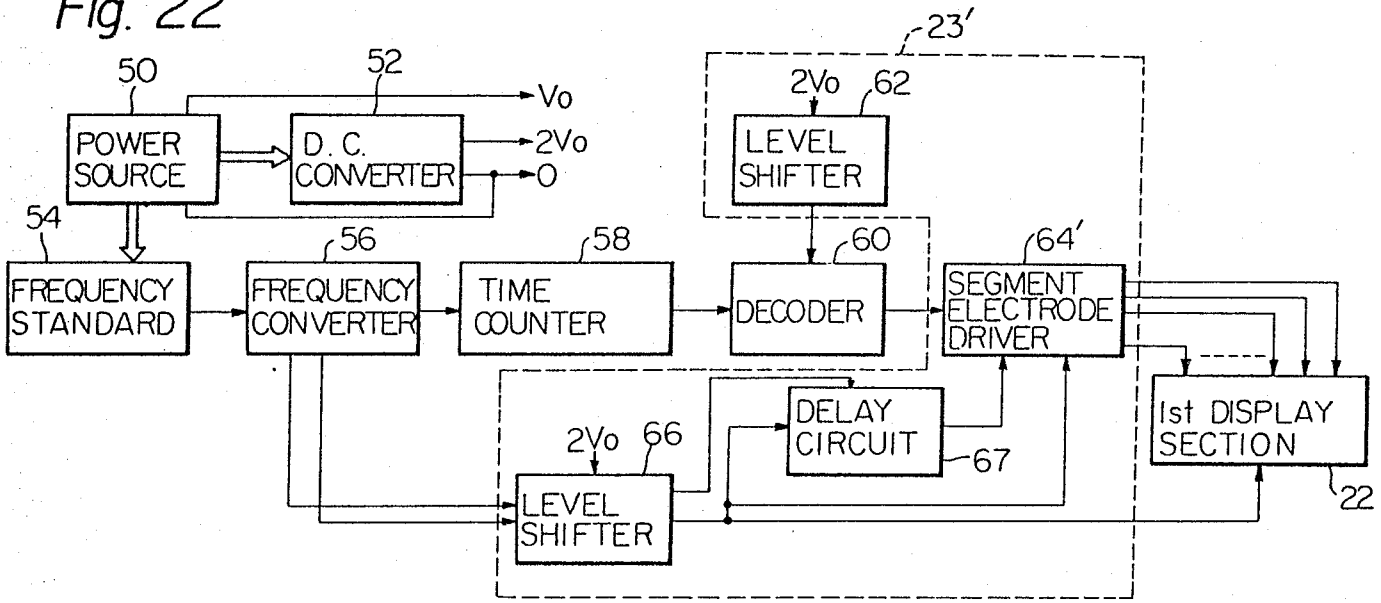
FIG. 22 is a block diagram of a modified form of the static drive system shown in FIGS. 3 and 5.

FIG. 22 shows a modified form of the static drive system shown in FIGS. 3 or 5 with like parts bearing like reference numerals as those used in FIGS. 3 or 5 with the exception that a single suffix (′) is added to a modified element. In this modification, the static drive system 23′ is further provided with a delay circuit 67 connected between the frequency converter 56 and the segment electrode driver 64′.

Figure 23:
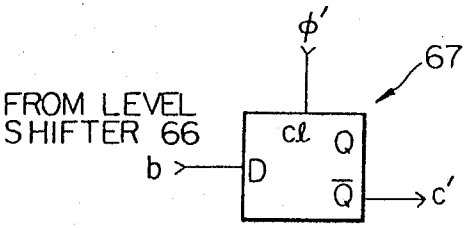
FIG. 23 is a schematic view of an example of a delay circuit shown in FIG. 22.

As shown in FIG. 23, the delay circuit 67 comprises a data-type flip-flop having its data terminal coupled to the level shifter 66 to receive a common electrode drive signal *b* therefrom. The clock terminal of the flip-flop is connected to the level shifter 66 to receive a clock signal $\phi'$ to generate an output having the polarity opposite to that of the common electrode drive signal *b* and delayed in phase therefrom by a predetermined interval equal to a half cycle of the clock signal $\phi'$ as shown by the waveform $c'$ in FIG. 26. The output $c'$ from the delay circuit 67 and the common electrode drive signal *b* are applied to the segment electrode driver 64′ which generates outputs in a manner as will be subsequently described in detail.

Figure 24:
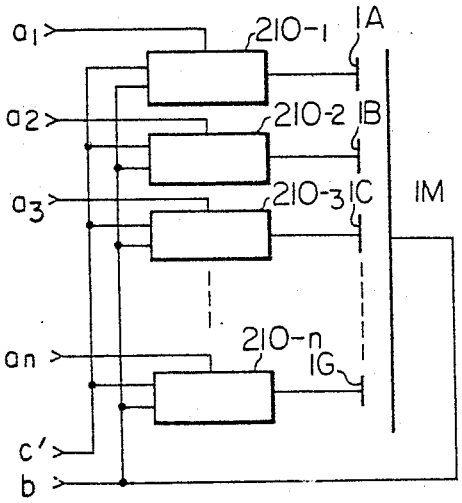
FIG. 24 is a diagrammatic representation of an example of the segment electrode driver shown in FIG. 22.
Figure 25:
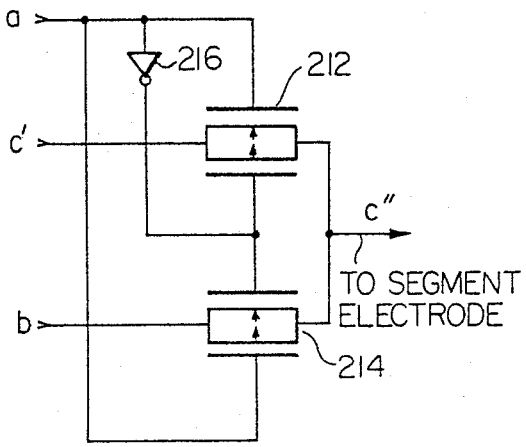
FIG. 25 is a detailed circuitry for the switching circuit shown in FIG. 24.

FIG. 24 shows an example of the segment electrode driver 64′. As shown, the segment electrode driver 64′ comprises switching circuits 210-1, 210-2, 210-3 ... and **210-*n*. Each switching circuit comprises first and second transmission gates 212 and 214, as shown in FIG. 25. The first transmission gate 212 has its control terminal coupled to the decoder 60 to receive a binary coded signal $a_1$, $a_2$, $a_3$ ... or $a_n$ as a time data signal, its input coupled to the delay circuit 67 to receive a delayed signal $c'$, and its output coupled to the output terminal of the second transmission gate 214 and connected to the segment electrode. The second transmission gate 214 has its control terminal coupled through an inverter 216 to the decoder 60 to receive a signal which is the inverse of the data signal $a_1$, $a_2$, $a_3$... or $a_n$, and its input coupled to the level shifter 66** to receive the signal *b*.

Figure 26:
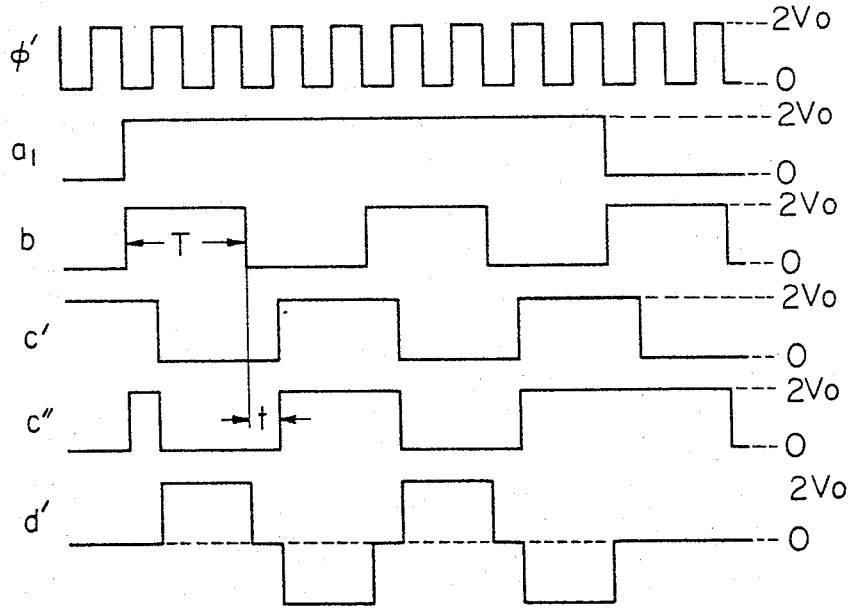
FIG. 26 is a timing chart illustrating the time relationship of the signals applied to the common electrode and the segment electrode.

When the data signal $a_1$ goes to a high level as shown in FIG. 26, the first transmission gate 212 is turned ON and the second transmission gate 214 is turned OFF. Thus, the switching circuit generates an output, as shown by the waveform *c''* in FIG. 26, which is applied to the segment electrode. Since, at the same time, the common electrode is applied with the drive signal *b*, the voltage potential across the electrodes varies in a manner as shown by the waveform *d'* and the segment will attain a light scattering state. When, on the other hand, the data signal $a_1$ goes to a low level, the first transmission gate 212 is turned OFF and the second transmission gate 214 is turned ON. In this condition, the drive signal *b* is applied to the segment electrode and, at the same time, the drive signal is also applied to the common electrode so that the segment will attain a light transparent state.

It should be noted that in a case where the first and second display sections 22 and 24 are driven by the static drive system 23 and the matrix drive system 25, respectively, using a common power source, the rout mean square voltage for the liquid crystal to be driven by the static drive system is higher than that for the liquid crystal to be driven by the matrix drive system whereby there exists a difference in display contrast between the first and second display sections 22 and 24. For example, the rout mean square voltage $V_{s2}$ for the liquid crystal at matrix driving in a case where $n = 2$ (in which $n$ indicates the number of digit electrodes) is expressed by:

$$V_{s2} = \sqrt{(5/2)}\, V_o = 2.37\, V_{rms}$$

Where $V_o = 1.5$ volts

On the other hand, the rout mean square voltage $V_{s1}$ for the liquid crystal at static driving is expressed by $V_{s1} = 3\, V_o$rms. In order to provide a uniform display contrast between the liquid crystal to be driven by the static drive system and the liquid crystal to be driven by the matrix drive system, it is necessary to select the rout mean square voltage attained by the static drive system to a value substantially equal to the rout mean square voltage attained by the matrix drive system. The rout mean square voltage for the liquid crystal to be driven by the static drive system is expressed by:

$$V_{s1} = 2V_o\sqrt{(T-t)/T}$$

where $T$ = pulse duration of the digit electrode drive signal *b*

$t$ = time interval for the delay of the segment electrode drive signal *c''*.

In order to select the rout mean square voltage attained by the static drive system to a value equal to that attained by the matric drive system, it is preferable to set $t/T \approx 0.36$. In other words, it is desired that the clock signal has a frequency of 128 Hz and the digit electrode drive signal has a frequency of 32 Hz.

It will thus be understood that the voltage potential across the electrodes provided by the static drive system 23' of FIG. 22 presents the rout mean square voltage substantially equal to that of the liquid crystal provided by the matrix drive system whereby a substantially uniform display contrast is obtained between the first and second display sections 22 and 24.

Figure 27:
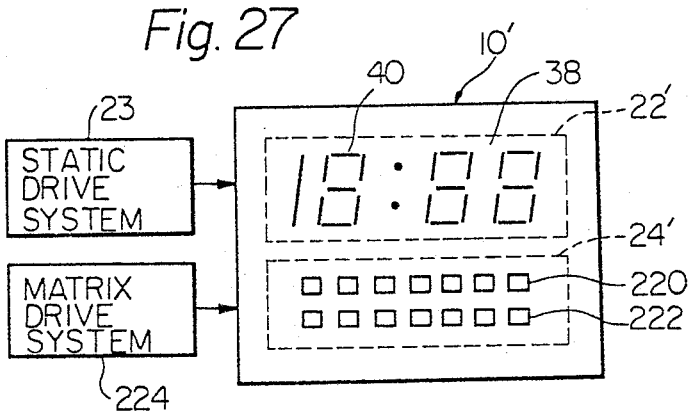
FIG. 27 is a plan view of another example of the liquid crystal display divice.

FIG. 27 shows another example of a display surface for an electronic timepiece. In this example, the first display section 22' comprises a minutes display station 38 and an hours display section 40. The second display section 24' comprises a first row 220 of display station composed of six display elements in the form of dots adapted to display seconds data and an additional display element adapted to display AM/PM marking, and a second row 222 of display station composed of seven display elements in the form of dots adapted to display the days of week. The first display section 22 is connected to and driven by the static drive system 23 in a manner as previously described above. The second display section 24' is connected to and driven by a matrix drive system 224 such that the first and second rows 220 and 222 of the display station are selectively operated in response to a control signal provided by an external control member in a manner as will be described below in detail.

Figure 28:
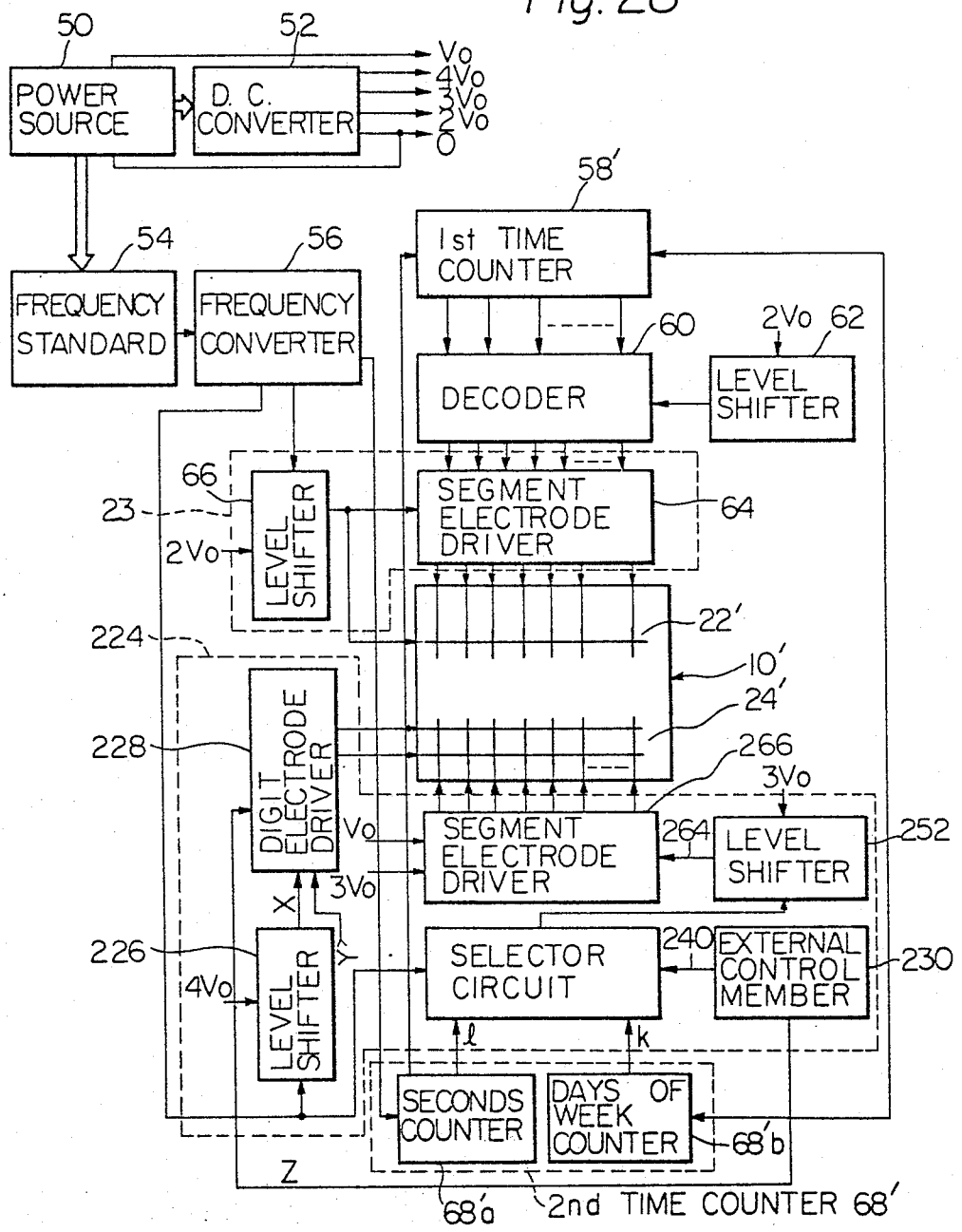
FIG. 28 is a block diagram of another preferred embodiment of an electronic timepiece of the present invention incorporating the display device shown in FIG. 27.

FIG. 28 shows a block diagram of an electronic timepiece for the display device shown in FIG. 27 with like or corresponding component parts bearing the same reference numerals as those used in FIG. 3. In this illustrated embodiment, the D.C. converter 52' is arranged to provide a plurality of output voltages such as $2V_o$, $3V_o$ and $4V_o$ for the purposes to be described hereinafter in detail. In FIG. 28, a first time counter 58' comprises a minutes counter coupled to an output of a seconds counter 68' a forming part of a second counter 68', and an hours counter coupled to the output of the minutes counter. The outputs from minutes counter and the hours counter are applied to the decoder 60 which provides seven segment binary coded signals for the minutes and hours display. The static drive system 23 shown in FIG. 28 may be arranged in the same manner as that described with reference to FIG. 3 and, therefore, a detailed description of the same is herein omitted.

The second time counter 68' comprises a days of week counter 68'b in addition to the seconds counter 68'a, the days of week counter 68'b being coupled to the output of the hours counter of the first time counter 58 to count the hours signal to provide outputs indicating the days of week. The outputs of the seconds counter 68'a and the days of week counter 68'b are selectively displayed on the second display section 24' by the matrix drive system 224.

Figure 29:
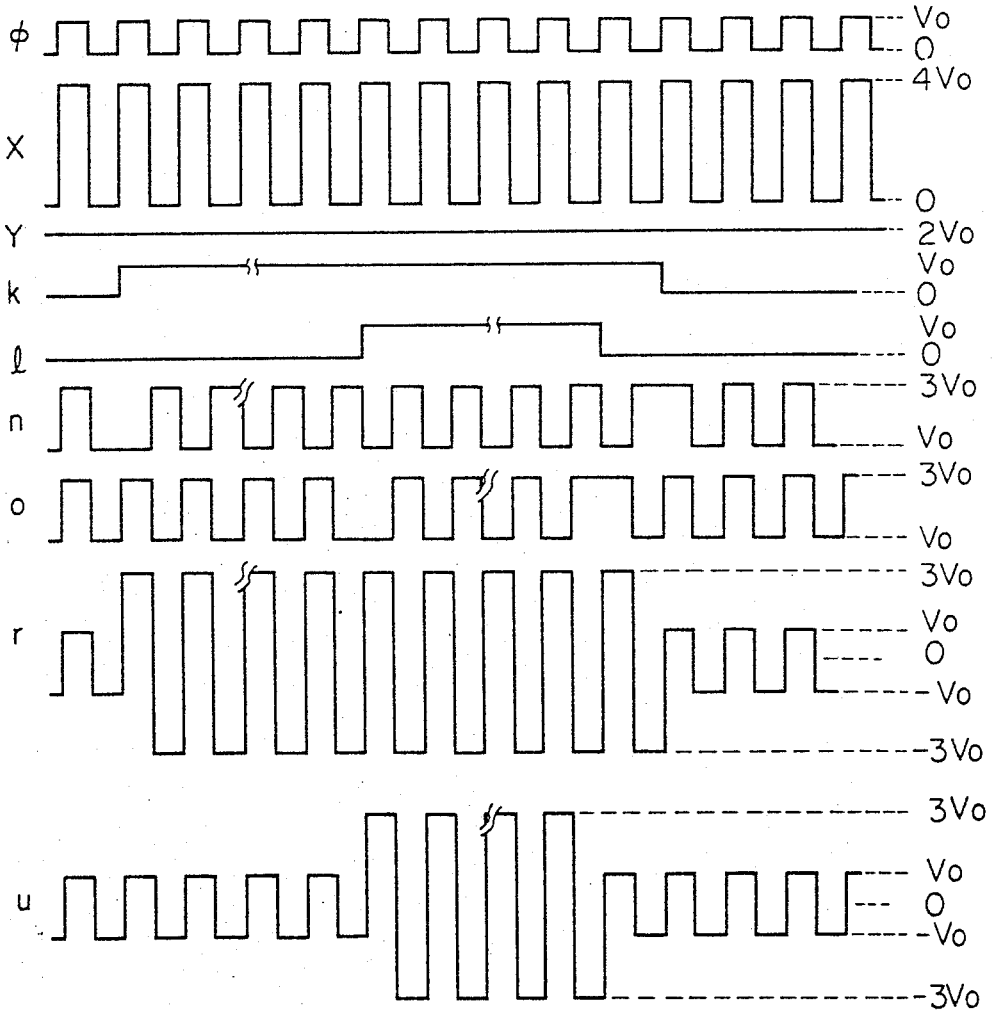
FIG. 29 is a timing chart illustrating the time relationship of the signals applied to the digit electrodes and the segment electrodes.

The matrix drive system 224 comprises a level shifter 226 coupled to the output of the frequency converter 56 to receive a clock signal $\phi$. The level shifter 226 is arranged to produce an output having voltage potential between 0 and 4 $V_o$ as shown by the waveform X in FIG. 29. The output X from the level shifter 226 and the output Y from the D.C. converter 52' are applied to a digit electrode driver 228 to which an external control member 230 is connected. The external control member 230 may comprise a push button type switch which is normally held in open condition and the control signal Z provided by the external control member 230 is at a low level. When the external control member 230 is actuated, i.e., when the switch is closed, the control signal Z goes to a high level at 4 $V_o$. The digit electrode driver 228 is responsive to the control signal and selectively control the supply of the signals X and Y to the digit electrodes $D_1$ and $D_2$ of the second display section 24'.

Figure 30:
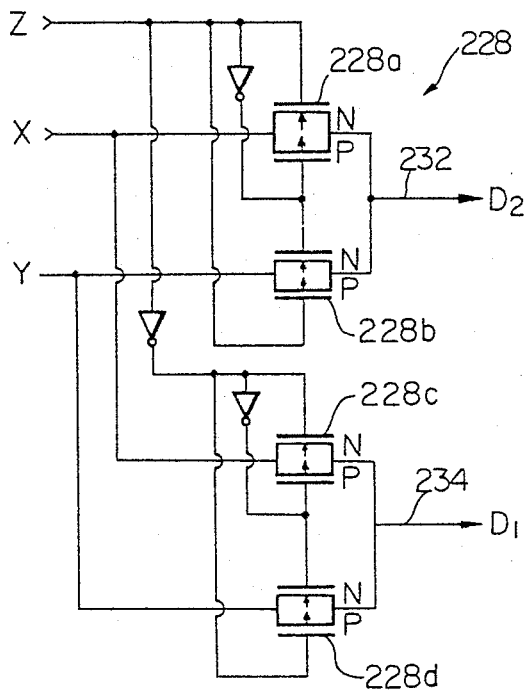
FIG. 30 is a diagrammatic representation of an example of the digit electrode drive system shown in FIG. 28.

A preferred example of the digit electrode driver 228 is shown in FIG. 30. As shown, the digit electrode driver 228 comprises first, second, third and fourth transmission gates 228*a*, 228*b*, 228*c* and 228*d*. The transmission gate 228*a* has its control terminal coupled to the external control member to receive the control signal Z therefrom, its input terminal coupled to the level shifter 226 to receive an input X, and its output terminal coupled to a line 232 connected to the second digit electrode $D_2$. The second transmission gate 228*b* has its control terminal coupled to receive a signal which is the inverse of the control signal Z, its input terminal coupled to the D.C. converter to receive an input Y therefrom, and an output terminal coupled to the output terminal of the first transmission gate 228*a* to which the second digit electrode $D_2$ is coupled through the line 332. The third transmission gate 228*c* has its control terminal adapted to receive a signal which is the inverse of the control signal Z, its input terminal coupled to receive the input X, and its output terminal coupled to a line 234 connected to the first digit electrode $D_1$. The fourth transmission gate 228*d* has its control terminal adapted to receive the control signal Z, its input terminal adapted to receive the input Y, and its output terminal coupled to the output terminal of the third transmission gate T.G.42 to which the first digit electrode $D_1$ is coupled through the line 234.

As already mentioned above, since the control signal is normally at a low level, the first transmission gate 228*a* is turned OFF while the second transmission gate 228*b* is turned ON so that an output Y is applied to the digit electrode $D_2$. Under this condition, the second row 222 of display station for the days of week is not driven for a reason as will be subsequently described. At the same time, the third transmission gate 228*c* is turned ON while the fourth transmission gate 228*d* is turned OFF so that the output X is applied to the digit electrode $D_1$. Under this condition, the voltage potential across the electrodes for the first row 220 for the seconds display is greater than the threshold voltage of the liquid crystal and, thus, the seconds data and the AM/PM mark data are displayed as will be subsequently described.

When the external control member 230 is actuated, the control signal Z goes to a high level. In this instance, the first transmission gate 228*a* is turned ON while the second transmission gate 228*b* is turned OFF so that the output X is passed through the line 232 to the second digit electrode $D_2$. At the same time, the third transmission gate 228*c* is turned OFF while the fourth transmission gate 228*d* is turned ON so that the output Y is passed through the line 234 to the first digit electrode $D_1$. Under these circumstances, the days of week data is displayed by the second row 222 of display station and the display of the seconds data by the first row 220 is prevented. It will thus be possible to select the displays of the seconds data and the days of week data by the manual operation of the external switch.

Figure 31:
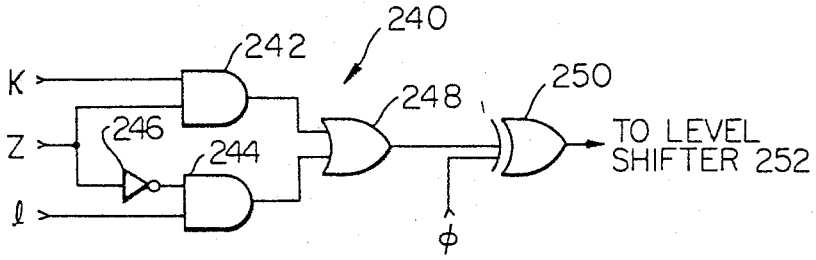
FIG. 31 is a detailed circuitry of an example of a selector circuit shown in FIG. 28.

Turning now to FIG. 28, the matrix drive system 224 further comprises a selector circuit 240 for selecting an output *l* from the seconds counter 68'*a* and an output *k* from the days of week counter 68'*b* in response to the control signal Z from the external control member 230. As shown in FIG. 31, the selector circuit comprises first and second AND gates 242 and 244, an OR gate 248 and an EXCLUSIVE OR gate 250. The first AND gate has its one input coupled to the days of week counter 68'*b* to receive the output as shown by the waveform *k* in FIG. 29, and the other input coupled to the external control member 230 to receive the control signal Z. The second AND gate 244 has its one input coupled to the output of an inverter 246 to receive a signal which is the inverse of the control signal Z, and the other input coupled to the seconds counter to receive an output as shown by the waveform *l* in FIG. 29. The output of the first AND gate 242 is coupled to one input of the OR gate 248, to the other input of which is coupled to the output of the second AND gate 244. The output of the OR gate 248 is coupled to one input of the EXCLUSIVE OR gate 250 whose another input is coupled to the frequency converter 56 to receive a clock signal as shown by the waveform $\phi$ in FIG. 29.

As previously stated, the control signal Z is normally at a low level so that the first AND gate 242 is inhibited and the second AND gate 244 is opened. Under this condition, the output *l* is passed through the OR gate 248 to the one input of the EXCLUSIVE OR gate 250 to which the clock signal $\phi$ is also applied. In this instance, the EXCLUSIVE OR gate 250 produces an output. When the control signal Z goes to a high level, the second AND gate 244 is inhibited and the first AND gate 242 is opened so that the output *k* is applied through the OR gate 248 to the EXCLUSIVE OR gate 250 to which the clock signal $\phi$ is also applied. In this case, the EXCLUSIVE OR gate 250 produces an output. The outputs from the selector circuit 240 are applied to a level shifter 252 which generates outputs having voltage potential varying between 0 and 3 $V_o$.

Figure 32:
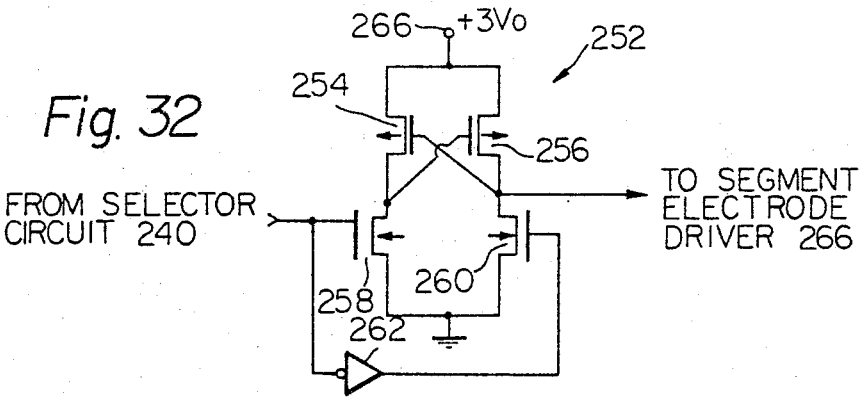
FIG. 32 shows a preferred example of the level shifter associated with the selector circuit shown in FIG. 28.

An example of the level shifter 252 is illustrated in FIG. 32. As shown, the level shifter 252 comprises p-type MOS transistors 254 and 256, n-type MOS transistors 258 and 260, and an inverter 262. The p-type MOS transistor 254 has the gate terminal connected to a line 252 to which the drain terminal of the p-type MOS transistor 256 and the drain terminal of the n-type MOS transistor 260 are also connected. The source terminal of the p-type MOS transistor 254 is coupled to a terminal 266 to receive a 3 $V_o$ signal from the D.C. converter 52'. The drain terminals of the p-type MOS transistor 254 and the n-type MOS transistor 258 are coupled together and connected to the gate terminal of the p-type MOS transistor 256. The gate terminal of the n-type MOS transistor 258 is connected to the output of the EXCLUSIVE OR gate 250, to which the gate terminal of the n-type MOS transistor 260 is also coupled via the inverter 262. The source terminals of the n-type MOS transistors 258 and 260 are grounded. The source terminal of the p-type MOS transistor 256 is coupled to the terminal 266.

With the arrangement mentioned above, when the output from the EXCLUSIVE OR gate 250 is at a high level, i.e., at a potential $V_o$, the n-type MOS transistor 258 and the p-type MOS transistor 256 are turned ON while the p-type MOS transistor 254 and the n-type MOS transistor 260 are turned OFF, so that a 3 $V_o$ output appear on line 264. When the output from the EXCLUSIVE OR gate 250 goes to a low level, i.e., at a zero potential, the p-type MOS transistor 254 and the n-type MOS transistor 260 are turned ON while the p-type MOS transistor 256 and the n-type MOS transistor 258 are turned OFF, so that a zero volt output appear on line 264. In this manner, the level shifter produces the outputs which vary in potential between 0 and 3 $V_o$. The outputs from the level shifter 252 are applied to a segment electrode driver 266 through the line 264.

Figure 33:
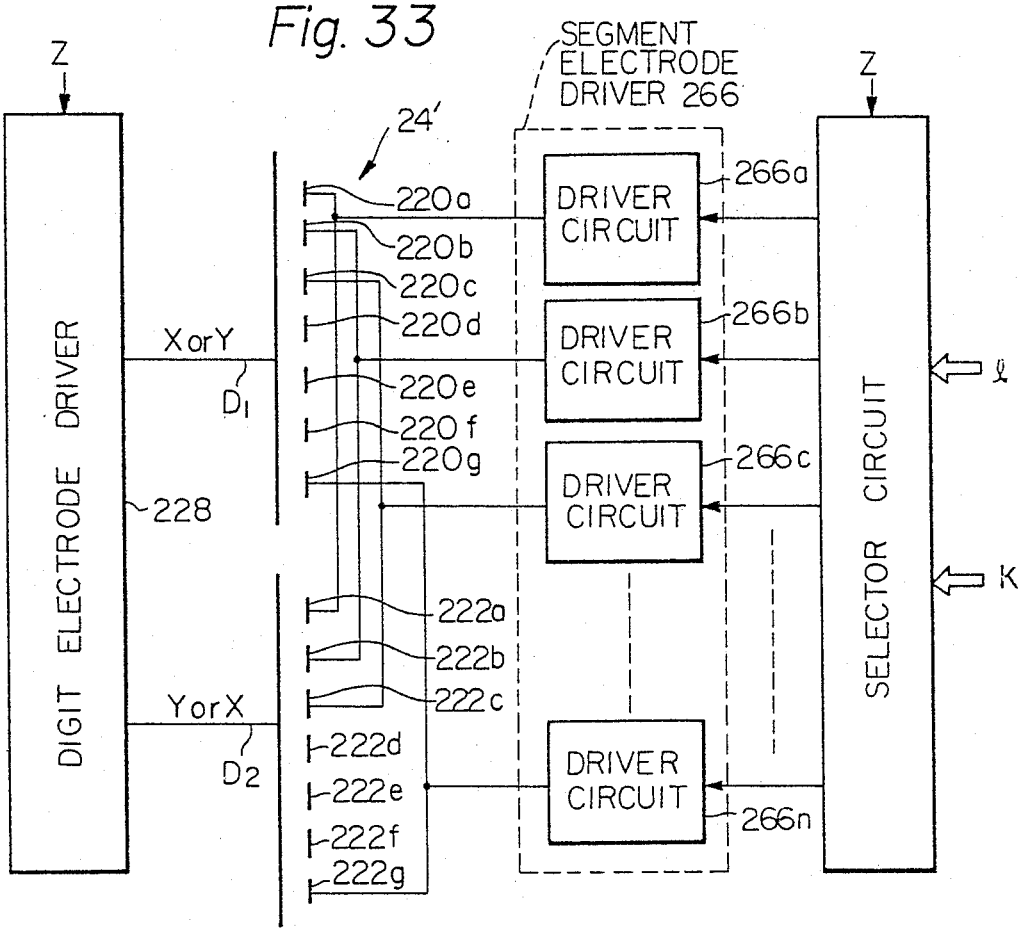
FIG. 33 is a diagrammatic representation of the electrical interconnections of the segment electrodes and the driver circuits for the matrix drive system shown in FIG. 28.

As shown in FIG. 33, the segment electrode driver 266 comprises seven driver circuits 266*a*, 266*b*, 266*c* and 266*n* having their outputs coupled to the segment electrodes 220*a* and 222*a*, 220*b* and 222*b*, 220*c* and 222*c* ... and 220*g* and 222*g*, respectively.

Figure 34:
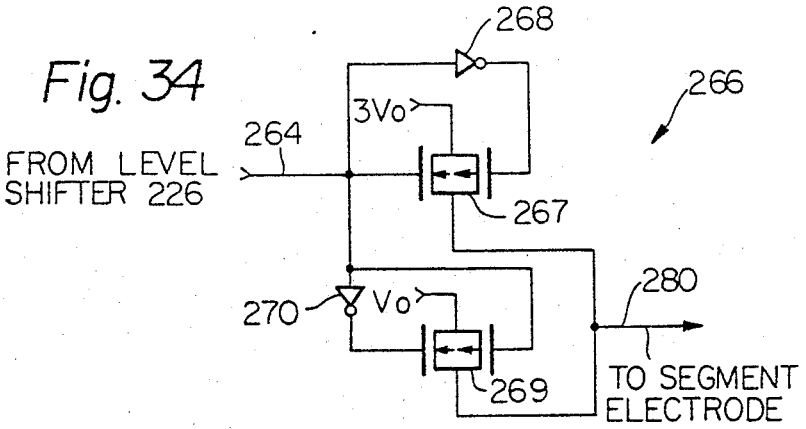
FIG. 34 is a diagrammatic representation of a portion of the segment electrode driver shown in FIG. 28.

As shown in FIG. 34, each driver circuit comprises first and second transmission gates 267 and 269, and inverters 268 and 270. The first transmission gate 267 is composed of an n-type MOS transistor having its gate terminal coupled to the output of the level shifter 252 through the line 264, and a p-type MOS transistor having its gate terminal coupled through the inverter 268 to the line 264. The source terminals of the n-type and p-type MOS transistors are coupled together and connected to the D.C. converter 52' to receive the outputs $V_o$ and $3V_o$, and the drain terminals are coupled to a line 280 connected to a segment electrode. Likewise, the second transmission gate 269 is composed of an n-type MOS transistor having its gate terminal coupled through the inverter 270 to the line 264 and a p-type MOS transistor having its gate terminal coupled to the line 264. The source terminals of the n-type and p-type MOS transistors constituting the second transmission gate 269 are coupled together and connected to the D.C. converter 52' to receive a $V_o$ signal therefrom, while the drain terminals are coupled to the line 280.

When the output signal from the level shifter 252 is at a high level, i.e., at a 3 $V_o$ potential, the first transmission gate 267 is turned ON while the second transmission gate 269 is turned OFF so that an output appearing at line 280 has a potential of 3 $V_o$. When the output signal from the level shifter goes to a low level, i.e., to a zero potential, the first transmission gate 267 is turned OFF while the second transmission gate 269 is turned OFF so that an output at the line 280 has a potential of $V_o$. Thus, the output produced by the segment electrode driver 266 varies in potential between $V_o$ and 3 $V_o$ as shown by the waveforms *n* and *o* in FIG. 29. The voltage potential across the electrodes varies in a manner as shown by the waveforms *r* and *u* in FIG. 29. It will thus be understood that the voltage signals *n* and *o* are applied to the segment electrodes exclusively of the voltage signal applied tothe digit electrode or the data signal and have a duty cycle closest to a value of 100% duty cycle whereby clear display contrast can be obtained even in the matrix drive method.

While the present invention has been shown and described with reference to particular embodiments by way of example, it should be noted that various other changes or modifications may be made without departing from the scope of the present invention. For example, with the level shifters 62, 66, 74 and 78 have been shown and described as being directly coupled to the decoder 60, frequency converter 56, segment electrode driver 72, and digit electrode driver 76, respectively, it should be understood that a level shifter may be coupled between intermediate stages of the frequency divider to provide an output at an increased voltage level by which the time counter, decoder and segment electrode driver are driven, reducing the number of level shifters.

What is claimed is:

1. An electronic timepiece comprising, in combination:

a frequency standard providing a relatively high frequency signal;

a frequency converter responsive to said relatively high frequency signal to provide a low frequency signal;

a first time counter responsive to said low frequency signal to provide a first time information signal; p1 a second time counter responsive to said first time information signal to provide a second time information signal;

a first decoder responsive to said first time information signal to provide first decoded outputs;

a second decoder responsive to said second time information signal to provide second decoded outputs;

a liquid crystal display device including a first display section and a second display section integrally formed within a single cell having first and second transparent glass plates and a body of liquid crystal material sealed between said transparent glass plates, said first display section including a common electrode and a plurality of segment electrodes displaced from and disposed opposite the common electrode, said second display section including a matrix array of a plurality of digit electrodes and a plurality of segment electrodes, said common electrode and said digit electrodes being disposed on an inner surface of said first transparent glass plate and the segment electrodes of said first and second display sections being disposed on an inner surface of said second transparent glass plate;

a static drive system coupled to said first decoder for driving said first display section in a static mode to display first time information in response to said first decoded outputs; and a matrix drive system coupled to said second decoder for driving said second display section to provide a display of second time information in response to said second decoded outputs;

said matrix drive system including a digit electrode driver having circuit means for applying to said digit electrodes an alternating voltage signal varying in potential at first, second and third voltage levels, and a segment electrode driver having circuit means for applying to selected one of the segment electrodes of said second display section a segment drive signal varying in potential between said first and third voltage levels, whereby the root mean square value of a voltage applied across the digit electrodes and the segment electrodes of said second display section has a predetermined value to display said second time information; and said static drive system including means for applying to said common electrode an alternating voltage signal varying in potential between said first and third voltage levels, and a segment electrode driver for applying to each of said segment electrodes of said first display section a reversed polarity alternating voltage signal exclusively of said alternating voltage signal applied to said common electrode, said reversed polarity alternating voltage signal varying in potential between said first and third voltage levels, and said segment electrode driver of said static drive system including means for delaying said reversed polarity alternating signal in phase from said alternating voltage signal applied to said common electrode whereby the root mean square value of a voltage applied across said common electrode and the segment electrode of said first display section is reduced to a value substantially equal to said predetermined value to provide a uniform display contrast between said first and second display sections.

2. An electronic timepiece according to claim 1, in which said first time information signal comprises a seconds signal, a minutes signal and an hours signal, and said second time information signal comprises a dates signal and a months signal.

3. An electronic timepiece according to claim 2, in which said first display section comprises a seconds display station, a minutes display station and an hours display station, and said second display section comprises a dates display station and a months display station.

4. A combination electronic timepiece and electronic calculator, comprising:

a frequency standard providing a relatively high frequency signal;

a frequency converter responsive to said relatively high frequency signal to provide a low frequency signal;

a time counter responsive to said low frequency signal to provide a time information signal;

a first decoder responsive to said time information signal to provide first decoded outputs;

a keyboard having aplurality of keys adapted to provide input signals when actuated;

a calculator circuit coupled to said keyboard to provide a calculation signal in response to said input signals;

a second decoder responsive to said calculation signal to provide second decoded outputs;

a liquid crystal display device including a first display section and a second display section integrally formed within a single cell having first and second transparent glass plates and a body of a liquid crystal material sealed betseen said first and second transparent glass plates, said first display section including a common electrode and a plurality of segment electrodes displaced from and disposed opposite to the common electrode, said second display section including a matrix array of a plurality of digit electrodes and a plurality of segment electrodes, said common electrode and said digit electrodes being disposed on an inner surface of said first transparent glass plate and the segment electrodes of said first and second display sections being disposed on an inner surface of said second transparent glass plate;

a static drive system coupled to said decoder for driving said first display section in a static mode to display time information in response to said first decoded outputs; and a matrix drive system coupled to said second decoder for driving said second display section to provide a display of calculated data in response to said second decoded outputs;

said matrix drive system including a digit electrode driver for applying to said digit electrodes a first alternating voltage signal varying in potential between first, second and third voltage levels, and a segment electrode driver for applying to each of said segment electrodes of said second display section a segment drive signal varying in potential between said first and third voltage levels, whereby the root mean square value of a voltage applied across said digit electrodes and said segment electrodes of said second display section has a predetermined value to display said calculated data; and said static drive system including means for applying to said common electrode a second alternating voltage signal varying in potential between said first and third voltage levels, and a segment electrode driver for applying to each of said segment electrodes of said first display section a reversed polarity alternating voltage signal exclusively of said second alternating voltage signal, said reversed polarity alternating voltage signal varying in potential between said first and third voltage levels, and said segment electrode driver of said static drive system including means for delaying said reversed polarity voltage signal in phase from said second alternating voltage signal applied to said common electrode whereby the root mean square value of a voltage applied across said common electrode and said segment electrodes of said first display section is reduced to a value substantially equal to said predetermined value to provide a uniform display contrast between said first and second display sections.

* * * * *